US006557961B2

(12) United States Patent
Cheng et al.

(10) Patent No.: US 6,557,961 B2
(45) Date of Patent: May 6, 2003

(54) VARIABLE INK FIRING FREQUENCY TO COMPENSATE FOR PAPER COCKLING

(75) Inventors: Peter L. Cheng, Irvine, CA (US); Akihiko Hamamoto, Irvine, CA (US); Takao Aichi, Irvine, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/886,088

(22) Filed: Jun. 22, 2001

(65) Prior Publication Data

US 2002/0196298 A1 Dec. 26, 2002

(51) Int. Cl.[7] ..... B41J 29/38
(52) U.S. Cl. ..... 347/9; 247/14
(58) Field of Search ..... 347/9, 14, 101, 347/104

(56) References Cited

U.S. PATENT DOCUMENTS

| | | | | |
|---|---|---|---|---|
| 3,886,862 A | | 6/1975 | Hamisch, Jr. | 101/109 |
| 4,843,338 A | | 6/1989 | Rasmussen et al. | 347/8 |
| 4,872,026 A | | 10/1989 | Rasmussen et al. | 347/56 |
| 4,951,067 A | | 8/1990 | Spehrley, Jr. | 347/102 |
| 4,965,612 A | | 10/1990 | Sakaki et al. | 347/100 |
| 5,041,846 A | | 8/1991 | Vincent et al. | 347/102 |
| 5,043,741 A | | 8/1991 | Spehrley, Jr. | 347/88 |
| 5,356,229 A | | 10/1994 | Hickman et al. | 400/642 |
| 5,393,151 A | | 2/1995 | Martin et al. | 400/642 |
| 5,419,644 A | | 5/1995 | Martin et al. | 400/642 |
| 5,510,822 A | | 4/1996 | Vincent et al. | 347/102 |
| 5,519,425 A | | 5/1996 | Dietl et al. | 347/87 |
| 5,563,643 A | | 10/1996 | Carlotta et al. | 347/87 |
| 5,576,744 A | * | 11/1996 | Niikura et al. | 347/14 |
| 5,644,343 A | | 7/1997 | Allen | 347/17 |
| 5,650,808 A | | 7/1997 | Vincent et al. | 347/43 |
| 5,673,069 A | | 9/1997 | Canfield et al. | 347/15 |
| 5,736,995 A | | 4/1998 | Bohorquez et al. | 347/14 |
| 5,751,303 A | | 5/1998 | Erickson et al. | 347/16 |
| 5,764,263 A | | 6/1998 | Lin | 347/101 |
| 5,812,152 A | | 9/1998 | Torigoe et al. | 347/2 |
| 5,820,283 A | | 10/1998 | Sunada et al. | 400/642 |
| 5,825,377 A | | 10/1998 | Gotoh et al. | 347/15 |
| 5,838,338 A | | 11/1998 | Olson | 347/8 |
| 5,847,719 A | | 12/1998 | Yamaguchi et al. | 346/134 |
| 5,861,895 A | | 1/1999 | Tajika et al. | 347/14 |
| 5,864,349 A | | 1/1999 | Hirabayashi et al. | 347/39 |
| 5,864,350 A | | 1/1999 | Shioya et al. | 347/40 |
| 5,874,979 A | * | 2/1999 | Ohyama | 347/104 |
| 5,894,314 A | | 4/1999 | Tajika et al. | 347/14 |
| 5,896,143 A | | 4/1999 | Matsui et al. | 347/24 |
| 5,898,449 A | | 4/1999 | Narang et al. | 347/87 |
| 5,907,342 A | | 5/1999 | Sakaki et al. | 347/105 |
| 5,907,666 A | | 5/1999 | Yano et al. | 395/109 |
| 5,960,161 A | | 9/1999 | Bloomberg et al. | 395/109 |
| 5,992,962 A | | 11/1999 | Yen et al. | 347/9 |
| 6,000,781 A | | 12/1999 | Akiyama et al. | 347/40 |
| 6,020,906 A | | 2/2000 | Adams et al. | 347/217 |
| 6,027,211 A | | 2/2000 | Unosawa et al. | 347/104 |
| 6,068,373 A | | 5/2000 | Chen et al. | 347/105 |
| 6,084,604 A | | 7/2000 | Moriyama et al. | 347/15 |
| 6,331,042 B1 | * | 12/2001 | Yamada | 347/19 |
| 6,352,327 B1 | * | 3/2002 | Yano et al. | 347/14 |
| 6,359,701 B1 | * | 3/2002 | Yamada et al. | 358/1.2 |
| 6,364,452 B1 | * | 4/2002 | Noyes et al. | 347/43 |

FOREIGN PATENT DOCUMENTS

| | | | |
|---|---|---|---|
| EP | 925928 | 6/1999 | B41J/2/05 |

* cited by examiner

*Primary Examiner*—John Barlow
*Assistant Examiner*—A. Dudding
(74) *Attorney, Agent, or Firm*—Fitzpatrick, Cella, Harper & Scinto

(57) ABSTRACT

A method of preventing printing artifacts by detecting a distance between the print head and the recording medium as the print head and the recording medium and utilizes the detected distance in determining an adjusted ink ejection frequency. The adjusted ejection frequency for each print head scan position may be stored in a look up table.

52 Claims, 19 Drawing Sheets

FIG. 17

| | 300 | 301 | 302 | 303 | | | | 304 | 310 | 305 | 306 | 307 | 308 | 309 |
|---|---|---|---|---|---|---|---|---|---|---|---|---|---|---|
| FORWARD | | | | | | | | | | | time to | | | |
| Vdrop | drop ang. | angle | Vdropx | Vdropy | Vcrx chge | head f | DPI | Vcrx | CP dist | g | reach paper | Vxtotal | x Dist | X' |
| mm/s | (deg) | (rad) | mm/s | mm/s | % | Hz | | mm/s | mm | mm/s^2 | s | mm/s | mm | micron |
| 15000 | 260 | 4.5379 | 2604.72 | -14772.12 | 100 | 12500 | 720 | 440.972 | -1.2 | 9800 | 8.1232E-05 | 3045.69 | 0.2474 | |
| 15000 | 260 | 4.5379 | 2604.72 | -14772.12 | 102 | 12500 | 720 | 449.792 | -1.2 | 9800 | 8.1232E-05 | 3054.51 | 0.2481 | 7.16E-01 |
| 15000 | 260 | 4.5379 | 2604.72 | -14772.12 | 104 | 12500 | 720 | 458.611 | -1.2 | 9800 | 8.1232E-05 | 3063.33 | 0.2488 | 1.43E+00 |
| 15000 | 260 | 4.5379 | 2604.72 | -14772.12 | 105 | 12500 | 720 | 463.021 | -1.2 | 9800 | 8.1232E-05 | 3067.74 | 0.2492 | 1.79E+00 |
| 15000 | 260 | 4.5379 | 2604.72 | -14772.12 | 106 | 12500 | 720 | 467.431 | -1.2 | 9800 | 8.1232E-05 | 3072.15 | 0.2496 | 2.15E+00 |
| 15000 | 260 | 4.5379 | 2604.72 | -14772.12 | 100 | 12500 | 720 | 440.972 | -1 | 9800 | 6.7694E-05 | 3045.69 | 0.2062 | -4.12E+01 |
| 15000 | 260 | 4.5379 | 2604.72 | -14772.12 | 102 | 12500 | 720 | 449.792 | -1 | 9800 | 6.7694E-05 | 3054.51 | 0.2068 | -4.06E+01 |
| 15000 | 260 | 4.5379 | 2604.72 | -14772.12 | 104 | 12500 | 720 | 458.611 | -1 | 9800 | 6.7694E-05 | 3063.33 | 0.2074 | -4.00E+01 |
| 15000 | 260 | 4.5379 | 2604.72 | -14772.12 | 105 | 12500 | 720 | 463.021 | -1 | 9800 | 6.7694E-05 | 3067.74 | 0.2077 | -3.97E+01 |
| 15000 | 260 | 4.5379 | 2604.72 | -14772.12 | 106 | 12500 | 720 | 467.431 | -1 | 9800 | 6.7694E-05 | 3072.15 | 0.2080 | -3.94E+01 |
| 15000 | 260 | 4.5379 | 2604.72 | -14772.12 | 100 | 12500 | 720 | 440.972 | -1.4 | 9800 | 9.4770E-05 | 3045.69 | 0.2886 | 4.12E+01 |
| 15000 | 260 | 4.5379 | 2604.72 | -14772.12 | 102 | 12500 | 720 | 449.792 | -1.4 | 9800 | 9.4770E-05 | 3054.51 | 0.2895 | 4.21E+01 |
| 15000 | 260 | 4.5379 | 2604.72 | -14772.12 | 104 | 12500 | 720 | 458.611 | -1.4 | 9800 | 9.4770E-05 | 3063.33 | 0.2903 | 4.29E+01 |
| 15000 | 260 | 4.5379 | 2604.72 | -14772.12 | 105 | 12500 | 720 | 463.021 | -1.4 | 9800 | 9.4770E-05 | 3067.74 | 0.2907 | 4.33E+01 |
| 15000 | 260 | 4.5379 | 2604.72 | -14772.12 | 106 | 12500 | 720 | 467.431 | -1.4 | 9800 | 9.4770E-05 | 3072.15 | 0.2911 | 4.37E+01 |
| RETURN | | | | | | | | | | | | | | |
| 15000 | 260 | 4.5379 | 2604.72 | -14772.12 | 100 | 12500 | 720 | -440.97 | -1.2 | 9800 | 8.1232E-05 | 2163.75 | 0.1758 | |
| 15000 | 260 | 4.5379 | 2604.72 | -14772.12 | 102 | 12500 | 720 | -449.79 | -1.2 | 9800 | 8.1232E-05 | 2154.93 | 0.1750 | -7.16E-01 |
| 15000 | 260 | 4.5379 | 2604.72 | -14772.12 | 104 | 12500 | 720 | -458.61 | -1.2 | 9800 | 8.1232E-05 | 2146.11 | 0.1743 | -1.43E+00 |
| 15000 | 260 | 4.5379 | 2604.72 | -14772.12 | 105 | 12500 | 720 | -463.02 | -1.2 | 9800 | 8.1232E-05 | 2141.70 | 0.1740 | -1.79E+00 |
| 15000 | 260 | 4.5379 | 2604.72 | -14772.12 | 106 | 12500 | 720 | -467.43 | -1.2 | 9800 | 8.1232E-05 | 2137.29 | 0.1736 | -2.15E+00 |
| 15000 | 260 | 4.5379 | 2604.72 | -14772.12 | 100 | 12500 | 720 | -440.97 | -1 | 9800 | 6.7694E-05 | 2163.75 | 0.1465 | -2.93E+01 |
| 15000 | 260 | 4.5379 | 2604.72 | -14772.12 | 102 | 12500 | 720 | -449.79 | -1 | 9800 | 6.7694E-05 | 2154.93 | 0.1459 | -2.99E+01 |
| 15000 | 260 | 4.5379 | 2604.72 | -14772.12 | 104 | 12500 | 720 | -458.61 | -1 | 9800 | 6.7694E-05 | 2146.11 | 0.1453 | -3.05E+01 |
| 15000 | 260 | 4.5379 | 2604.72 | -14772.12 | 105 | 12500 | 720 | -463.02 | -1 | 9800 | 6.7694E-05 | 2141.70 | 0.1450 | -3.08E+01 |
| 15000 | 260 | 4.5379 | 2604.72 | -14772.12 | 106 | 12500 | 720 | -467.43 | -1 | 9800 | 6.7694E-05 | 2137.29 | 0.1447 | -3.11E+01 |
| 15000 | 260 | 4.5379 | 2604.72 | -14772.12 | 100 | 12500 | 720 | -440.97 | -1.4 | 9800 | 9.4770E-05 | 2163.75 | 0.2051 | 2.93E+01 |
| 15000 | 260 | 4.5379 | 2604.72 | -14772.12 | 102 | 12500 | 720 | -449.79 | -1.4 | 9800 | 9.4770E-05 | 2154.93 | 0.2042 | 2.85E+01 |
| 15000 | 260 | 4.5379 | 2604.72 | -14772.12 | 104 | 12500 | 720 | -458.61 | -1.4 | 9800 | 9.4770E-05 | 2146.11 | 0.2034 | 2.76E+01 |
| 15000 | 260 | 4.5379 | 2604.72 | -14772.12 | 105 | 12500 | 720 | -463.02 | -1.4 | 9800 | 9.4770E-05 | 2141.70 | 0.2030 | 2.72E+01 |
| 15000 | 260 | 4.5379 | 2604.72 | -14772.12 | 106 | 12500 | 720 | -467.43 | -1.4 | 9800 | 9.4770E-05 | 2137.29 | 0.2026 | 2.68E+01 |

325 326 327 320

| Carriage Position | Column Heat Time Delta | Column Heat Time Count |
|---|---|---|
| 0 | 0 | 20 |
| 1 | 0 | 19 |
| 2 | 0 | 18 |
| 3 | 0 | 17 |
| 4 | 0 | 16 |
| 5 | 0 | 15 |
| 6 | 0 | 14 |
| 7 | 0 | 13 |
| 8 | 0 | 12 |
| 9 | 0 | 11 |
| 10 | 0 | 10 |
| 11 | 0 | 9 |
| 12 | 0 | 8 |
| 13 | 0 | 7 |
| 14 | 0 | 6 |
| 15 | 0 | 5 |
| 16 | 0 | 4 |
| 17 | 0 | 3 |
| 18 | 0 | 2 |
| 19 | 0 | 1 |

FIG. 20A

| Carriage Position | Column Heat Time Delta | Column Heat Time Count |
|---|---|---|
| 20 | 1 | 20 |
| 21 | 1 | 19 |
| 22 | 1 | 18 |
| 23 | 1 | 17 |
| 24 | 1 | 16 |
| 25 | 1 | 15 |
| 26 | 1 | 14 |
| 27 | 1 | 13 |
| 28 | 1 | 12 |
| 29 | 1 | 11 |
| 30 | 1 | 10 |
| 31 | 1 | 9 |
| 32 | 1 | 8 |
| 33 | 1 | 7 |
| 34 | 1 | 6 |
| 35 | 1 | 5 |
| 36 | 1 | 4 |
| 37 | 1 | 3 |
| 38 | 1 | 2 |
| 39 | 1 | 1 |

FIG. 20B

| Carriage Position | Column Heat Time Delta | Column Heat Time Count |
|---|---|---|
| 40 | −1 | 10 |
| 41 | −1 | 9 |
| 42 | −1 | 8 |
| 43 | −1 | 7 |
| 44 | −1 | 6 |
| 45 | −1 | 5 |
| 46 | −1 | 4 |
| 47 | −1 | 3 |
| 48 | −1 | 2 |
| 49 | −1 | 1 |
| 50 | 5 | 4 |
| 51 | 5 | 3 |
| 52 | 5 | 2 |
| 53 | 5 | 1 |
| | | |
| | | |
| | | |
| | | |
| | | |
| | | |

FIG. 20C

| Carriage Position | Column Heat Time Delta | Column Heat Time Count |
|---|---|---|
| 0 | 0 | 20 |
| 10 | 0 | 10 |
| 20 | 1 | 20 |
| 30 | 1 | 10 |
| 40 | −1 | 10 |
| 50 | 5 | 4 |

FIG. 21

VARIABLE INK FIRING FREQUENCY TO COMPENSATE FOR PAPER COCKLING

BACKGROUND OF THE INVENTION

1. Field of the Invention

The present invention relates to compensation for recording medium unevenness during printing operations. More specifically, the present invention relates to control over timing of ink droplet ejection to compensate for recording medium unevenness.

2. Description of the Related Art

Recording medium (paper) unevenness is a known phenomena in ink-jet printing operations. The recording medium unevenness (sometimes called "cockling") is caused by excessive wetting of the paper by the liquid ink. The cockling introduces an unknown waveform shape into the paper that causes problems during printing operations, such as interference with a recording head during scanning. That is, high spots in the waveform shape of the paper interfere or rub against the recording head as it scans across the paper. The interference can cause problems such as clogging of the ink nozzles on the recording head and smearing of the ink.

To minimize interference problems caused by cockling, it has been proposed to apply pressure to the paper ahead of the recording head as it scans across the paper. One way this has been done is to provide a smaller roller on the printer carriage ahead of the print head such that, as the roller scans across the paper, the roller flattens the uneven paper ahead of the print head. However, the roller only slightly reduces the amount of cockling in the paper and after the roller flattens the paper, the paper tends to return to its uneven condition. Therefore, although the roller somewhat reduces the possibility of interference with the recording head, other problems associated with paper cockling still exist.

Another problem associated with paper cockling is image roughness that is caused by an uneven spacing of the ink droplets as they contact the paper. The ink droplet spacing is dependent upon several factors, including the carriage speed, the ink ejection speed and the distance between the print head and the paper. As seen in FIGS. 13A and 13B, ink droplets are ejected by the recording head at a constant frequency (f) along the scan direction. If the paper is flat or at least very close to being flat as seen in FIG. 13A, the ink droplets contact the paper at approximately the same spacing (d). However, when cockling occurs in the paper and the paper takes on a waveform shape as seen in FIG. 13B, the ink droplets do not contact the paper with a constant spacing, but rather they contact the paper with a different and varying spacing. That is, although the ink droplets are ejected by the recording head at a constant frequency f, the waveform shape of the paper causes some of the ink droplets to contact the paper in a more narrow pattern (d1) than they were ejected at, and some of the ink droplets to contact the paper in a wider pattern (d2) than they were ejected at. Thus, the waveform shape effects the contact frequency because of the varying distance between the print head and the paper. As a result, even though the ink droplets were ejected at a constant frequency, the spacing between the ink droplets contacting the paper is not the same as the spacing frequency that they were ejected at and image roughness occurs.

This problem is made worse in bi-directional printing modes. In bi-directional printing, a line of ink droplets is printed in a forward scan of the recording head, the paper is advanced one line and then another line of ink droplets is printed in a reverse scan of the recording head. Therefore, in bi-directional scanning, the ink droplet frequency contacting the recording medium varies from line to line, which makes the image roughness even worse than unidirectional scanning.

The inventors herein have considered the foregoing problem and have considered a method to compensate for the varying contact frequency of the ink droplets by varying the frequency of ejecting the ink on a region by region basis. In somewhat more detail, FIG. 19 depicts a method considered by the inventors herein for compensating for the contact frequency discrepancies wherein the waveform shape of the paper is divided into a predetermined number of regions and control over the firing frequency is performed by an ASIC. Within each region (intra-region), the ink ejection frequency is set to the same value for the entire region. However, the ink ejection frequency between regions (inter-region) is varied from region to region. It has been found that this approach works well in compensating for the paper cockling, but the inventors herein have also determined that a different approach may be utilized to provide the compensation. As such, the present invention is different from the foregoing approach considered by the inventors herein.

SUMMARY OF THE INVENTION

The present invention addresses the foregoing by inducing a predetermined unevenness pattern into the recording medium, determining an adjusted ink ejection frequency based on the induced unevenness pattern and adjusting the frequency of ink droplet ejection at each position of a print head scan across the recording medium based on the adjusted frequency. As a result, the ink ejection frequency can be adjusted by a CPU at each print head scanning position to compensate for the known unevenness pattern. Therefore, ink droplets contact the recording medium in a more even spacing along a scan direction and image density roughness that would otherwise occur is reduced.

Accordingly, in one aspect the invention may be control of an ink ejection frequency to compensate for recording medium unevenness in printing by inducing a predetermined unevenness pattern into the recording medium, determining an adjusted ink ejection frequency for each of a plurality of print head scan positions for a scan of the print head across the recording medium, the adjusted ink ejection frequency being determined at least in part based on the induced unevenness pattern, adjusting a base ink ejection frequency for each scan position of the print head based on the determined adjusted ejection frequency, and controlling ink ejection by the print head based on the adjusted ink ejection frequency.

The determined adjusted ink ejection frequency may be stored in a storage medium in the form of a look-up table with the adjusted ink ejection frequency being obtained from the look-up table. In addition, a plurality of look-up tables corresponding to a plurality of recording medium types and printing modes may be stored in the storage medium, with the adjusted ink ejection frequency for each print head scan position being obtained from the respective look-up table based on a recording medium type and a printing mode selected by a user. The control of the ink ejection frequency is preferably performed by a CPU in the printing device.

The invention may be implemented with multiple print heads and in bi-directional printing. The multiple print heads may be controlled individually based on the color of ink that the print head ejects, as well as based on whether the print head is scanning in a forward or reverse direction.

Each print head can be controlled with the same control signal, especially if the print heads are spaced relative to one another a distance corresponding to the spacing between the cockling ribs. Spacing the print heads relative to one another a distance corresponding to the distance between the cockling ribs allows both color and black print data can be compensated for accordingly with the same control signal. However, if the print heads are not spaced relative to one another a distance corresponding the distance between the cockling ribs, then if color and black data are to be printed, the color print head may be controlled, and if only black data is to be printed, the black print head can be controlled. Additionally, bi-directional compensation can be provided for, thereby resulting in less density unevenness of mixed color images as well as bi-directional printed images.

The invention may further detect a distance between the print head and the recording medium as the print head scans across the recording medium and utilize the detected distance in determining an adjusted ink ejection frequency.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

FIG. 17 is an example of a table of values obtained for a base heat timing.

FIGS. 20A to 20C depict an example of a look-up table for an adjusted ink ejection frequency.

FIG. 21 depict a simplified version of the table depicted in FIGS. 20A to 20C.

DETAILED DESCRIPTION OF THE PREFERRED EMBODIMENTS

Figure 1:
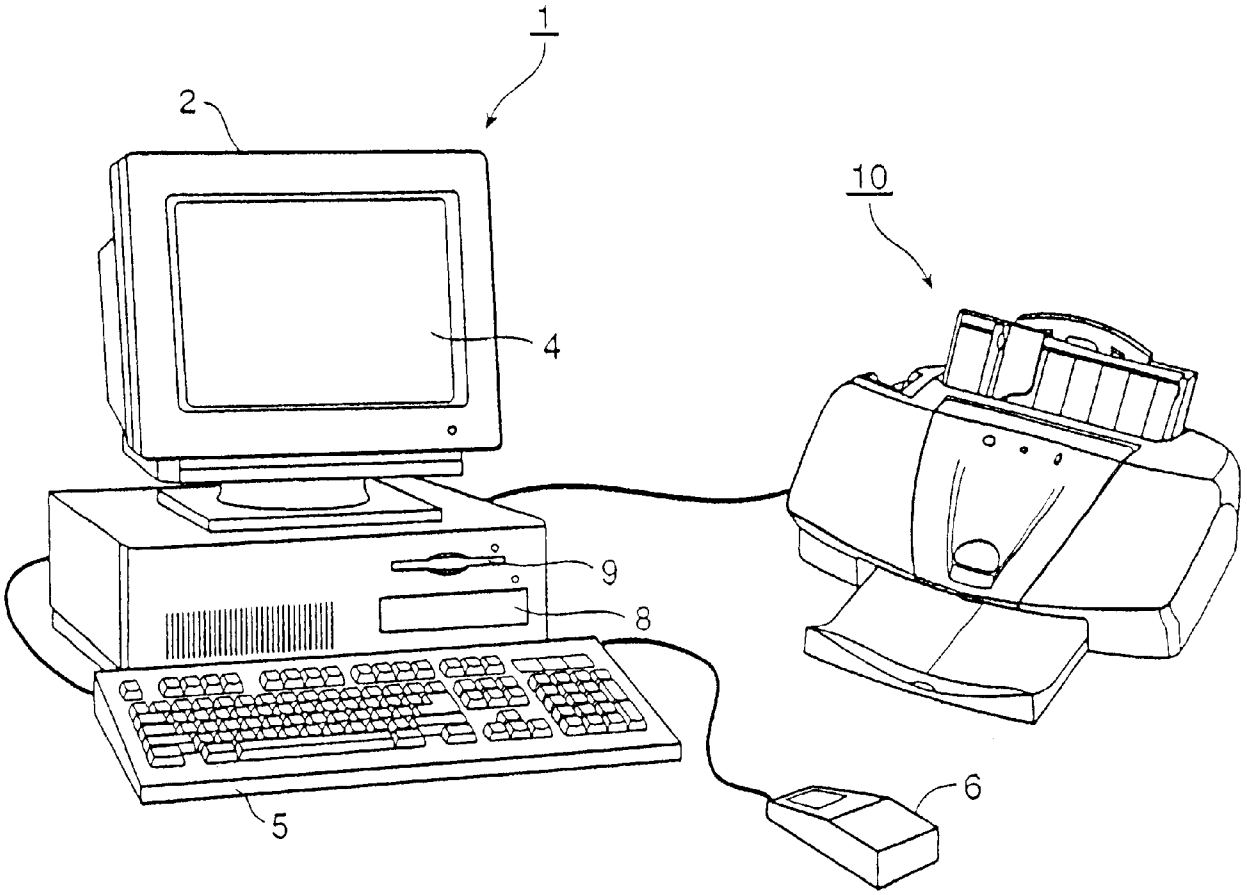
FIG. 1 shows a perspective view of computing equipment used in connection with the printer of the present invention.

FIG. 1 is a view showing the outward appearance of computing equipment used in connection with the invention described herein. Computing equipment 1 includes host processor 2. Host processor 2 comprises a personal computer (hereinafter "PC"), preferably an IBM PC-compatible computer having a windowing environment, such as Microsoft® Windows95. Provided with computing equipment 1 are display 4 comprising a color monitor or the like, keyboard 5 for entering text data and user commands, and pointing device 6. Pointing device 6 preferably comprises a mouse for pointing and for manipulating objects displayed on display 4.

Computing equipment 1 includes a computer-readable memory medium, such as fixed computer disk 8, and floppy disk interface 9. Floppy disk interface 9 provides a means whereby computing equipment 1 can access information, such as data, application programs, etc., stored on floppy disks. A similar CD-ROM interface (not shown) may be provided with computing equipment 1, through which computing equipment 1 can access information stored on CD-ROMs.

Disk 8 stores, among other things, application programs by which host processor 2 generates files, manipulates and stores those files on disk 8, presents data in those files to an operator via display 4, and prints data in those files via printer 10. Disk 8 also stores an operating system which, as noted above, is preferably a windowing operating system such as Windows95. Device drivers are also stored in disk 8. At least one of the device drivers comprises a printer driver which provides a software interface to firmware in printer 10. Data exchange between host processor 2 and printer 10 is described in more detail below.

Figure 2:
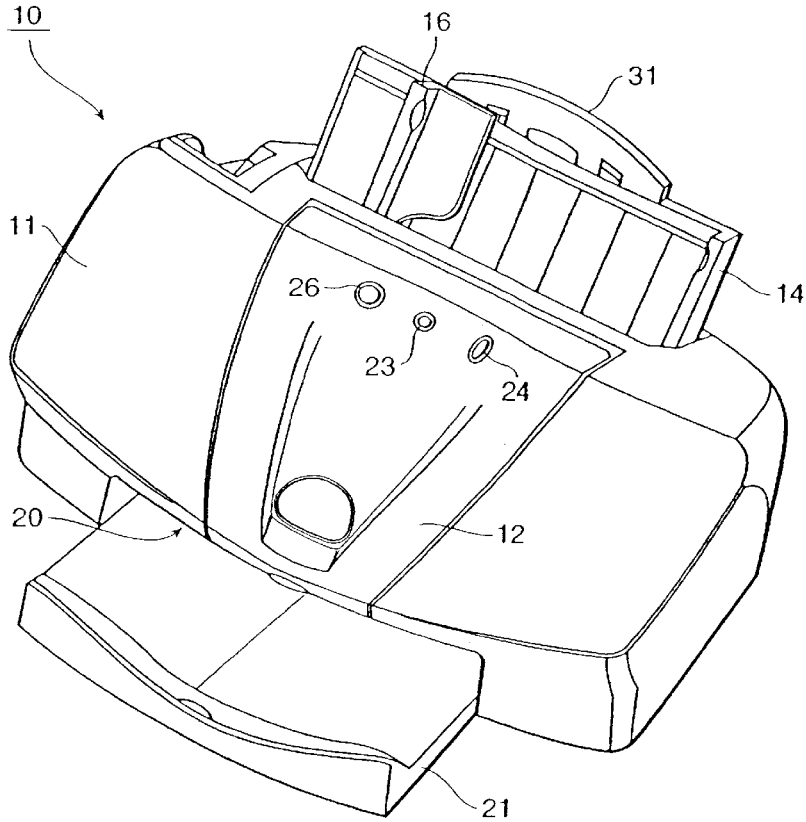
FIG. 2 is a front perspective view of the printer shown in FIG. 1.
Figure 3:
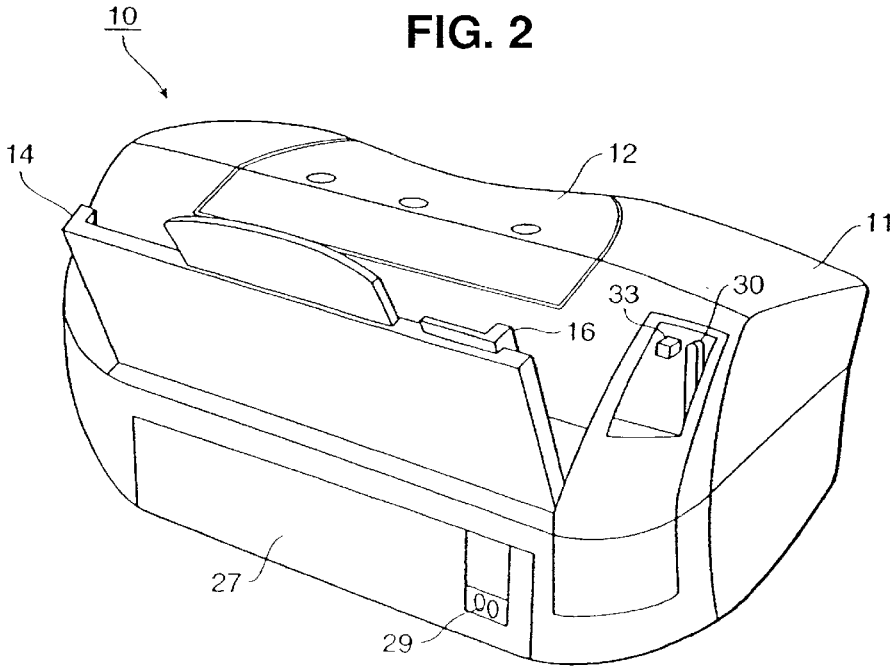
FIG. 3 is a back perspective view of the printer shown in FIG. 1.

FIGS. 2 and 3 show perspective front and back views, respectively, of printer 10. As shown in FIGS. 2 and 3, printer 10 includes housing 11, access door 12, automatic feeder 14, automatic feed adjuster 16, media eject port 20, ejection tray 21, power source 27, power cord connector 29, parallel port connector 30 and universal serial bus (USB) connector 33.

Housing 11 houses the internal workings of printer 10, including a print engine which controls the printing operations to print images onto recording media. Included on housing 11 is access door 12. Access door 12 is manually openable and closeable so as to permit a user to access the internal workings of printer 10 and, in particular, to access ink tanks installed in printer 10 so as to allow the user to change or replace the ink tanks as needed. Access door 12 also includes indicator light 23, power on/off button 26 and resume button 24. Indicator light 23 may be an LED that lights up to provide an indication of the status of the printer, i.e. powered on, a print operation in process (blinking), or a failure indication. Power on/off button 26 may be utilized to turn the printer on and off and resume button 24 may be utilized to reset an operation of the printer.

As shown in FIGS. 2 and 3, automatic feeder 14 is also included on housing 11 of printer 10. Automatic feeder 14 defines a media feed portion of printer 10. That is, automatic feeder 14 stores recording media onto which printer 10 prints images. In this regard, printer 10 is able to print images on a variety of types of recording media. These types include, but are not limited to, plain paper, high resolution paper, transparencies, glossy paper, glossy film, back print film, fabric sheets, T-shirt transfers, bubble jet paper, greeting cards, brochure paper, banner paper, thick paper, etc.

During printing, individual sheets which are stacked within automatic feeder 14 are fed from automatic feeder 14 through printer 10. Automatic feeder 14 includes automatic feed adjuster 16. Automatic feed adjuster 16 is laterally movable to accommodate different media sizes within automatic feeder 14. These sizes include, but are not limited to, letter, legal, A4, B5 and envelope. Custom-sized recording media can also be used with printer 10. Automatic feeder 14 also includes backing 31, which is extendible to support recording media held in automatic feeder 14. When not in use, backing 31 is stored within a slot in automatic feeder 14, as shown in FIG. 2.

As noted above, media are fed through printer 10 and ejected from eject port 20 into ejection tray 21. Ejection tray 21 extends outwardly from housing 11 as shown in FIG. 2 and provides a receptacle for the recording media upon ejection for printer 10. When not in use, ejection tray 21 may be stored within printer 10.

Power cord connector 29 is utilized to connect printer 10 to an external AC power source. Power supply 27 is used to convert AC power from the external power source, and to supply the converted power to printer 10. Parallel port 30 connects printer 10 to host processor 2. Parallel port 30 preferably comprises an IEEE-1284 bi-directional port, over which data and commands are transmitted between printer 10 and host processor 2. Alternatively, data and commands can be transmitted to printer 10 through USB port 33.

Figure 4:
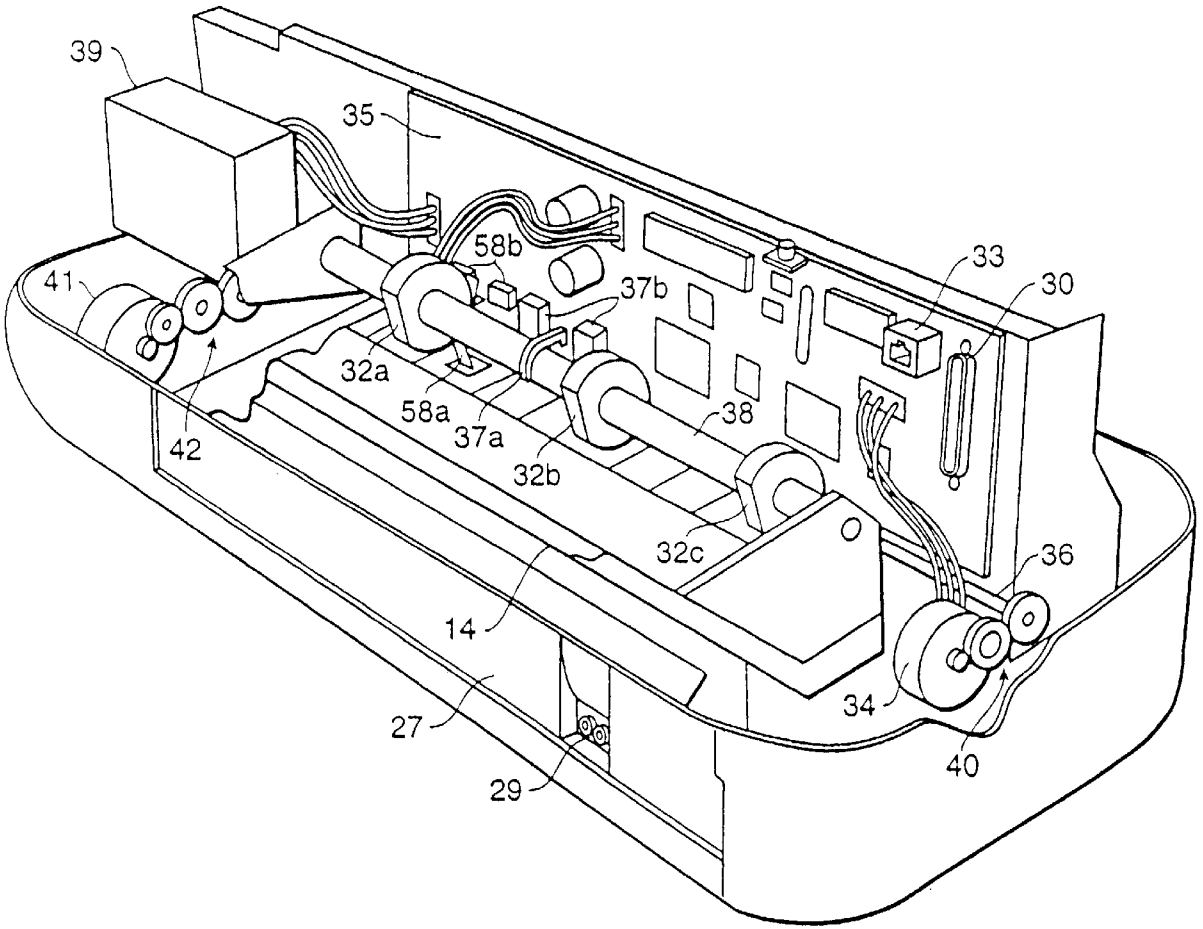
FIG. 4 is a back, cut-away perspective view of the printer shown in FIG. 1.
Figure 5:
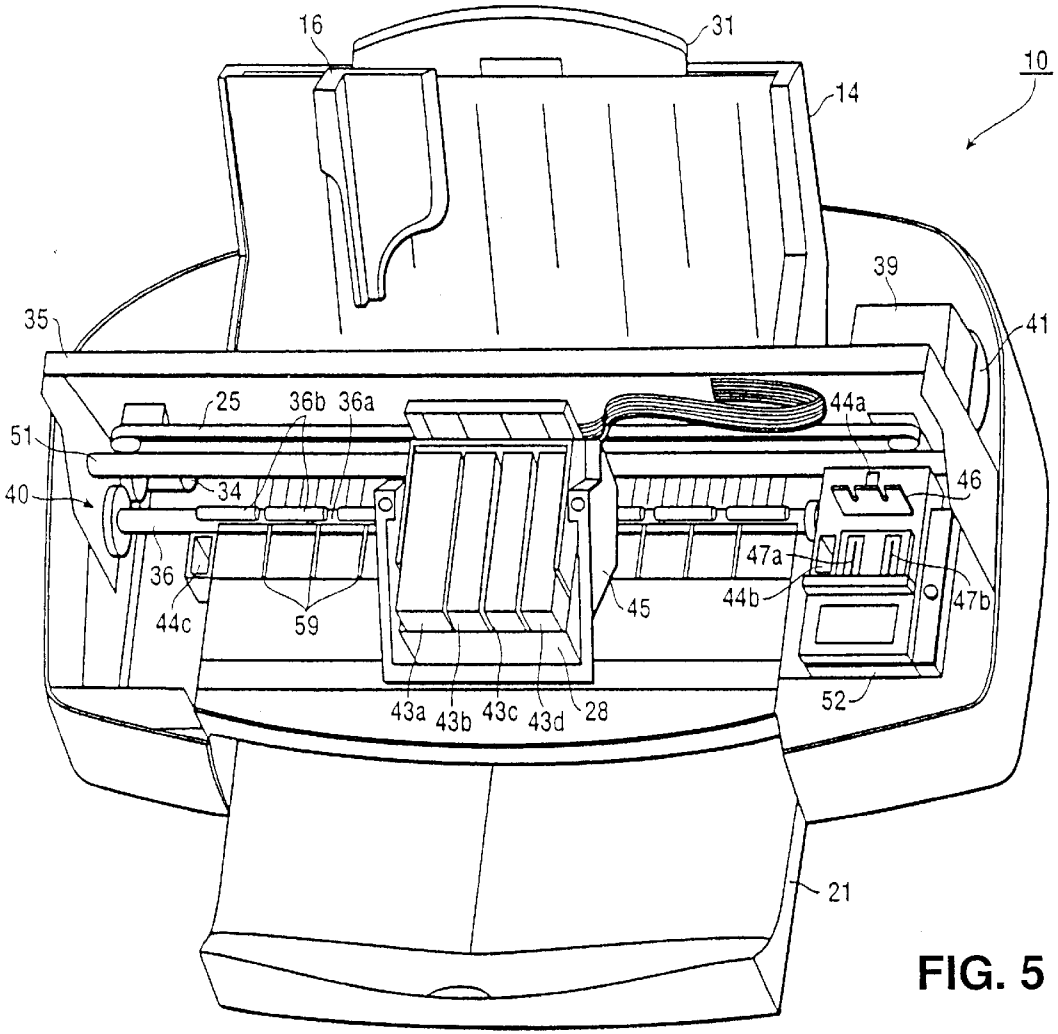
FIG. 5 is a front, cut-away perspective view of the printer shown in FIG. 1.

FIGS. 4 and 5 show back and front cut-away perspective views, respectively, of printer 10. As shown in FIG. 4, printer 10 includes an automatic sheet feed assembly (ASF) that comprises automatic sheet feeder 14, ASF rollers 32*a*, 32*b* and 32*c* attached to ASF shaft 38 for feeding media from automatic feeder 14. ASF shaft 38 is driven by drive train assembly 42. Drive train assembly 42 is made up of a series of gears that are connected to and driven by ASF motor 41. Drive train assembly 42 is described in more detail below with reference to FIGS. 6A and 6B. ASF motor 41 is preferably a stepper motor that rotates in stepped increments (pulses). Utilization of a stepper motor provides the ability for a controller incorporated in circuit board 35 to count the number of steps the motor rotates each time the ASF is actuated. As such, the position of the ASF rollers at any instant can be determined by the controller. ASF shaft 38 also includes an ASF initialization sensor tab 37*a*. When the ASF shaft is positioned at a home position (initialization position), tab 37*a* is positioned between ASF initialization sensors 37*b*. Sensors 37*b* are light beam sensors, where one is a transmitter and the other a receiver such that when tab 37*a* is positioned between sensors 37*b*, tab 37*a* breaks continuity of the light beam, thereby indicating that the ASF is at the home position.

Also shown in FIG. 4 is a page edge (PE) detector lever 58*a* and PE sensors 58*b*. PE sensors 58*b* are similar to ASF initialization sensors 37*b*. That is, they are light beam sensors. PE lever 58*a* is pivotally mounted and is actuated by a sheet of the recording medium being fed through the printer 10. When no recording medium is being fed through printer 10, lever 58*a* is at a home position and breaks continuity of the light beam between sensors 58*b*. As a sheet of the recording medium begins to be fed through the printer by the ASF rollers, the leading edge of the recording medium engages PE lever 58*a* pivotally moving the lever to allow continuity of the light beam to be established between sensors 58*b*. Lever 58*a* remains in this position while the recording medium is being fed through printer 10 until the trailing edge of the recording medium reaches PE lever 58*a*, thereby disengaging lever 58*a* from the recording medium and allowing lever 58*a* to return to its home position to break the light beam. The PE sensor is utilized in this manner to sense when a page of the recording medium is being fed through the printer and the sensors provide feedback of such to a controller on circuit board 35.

Figure 6A:
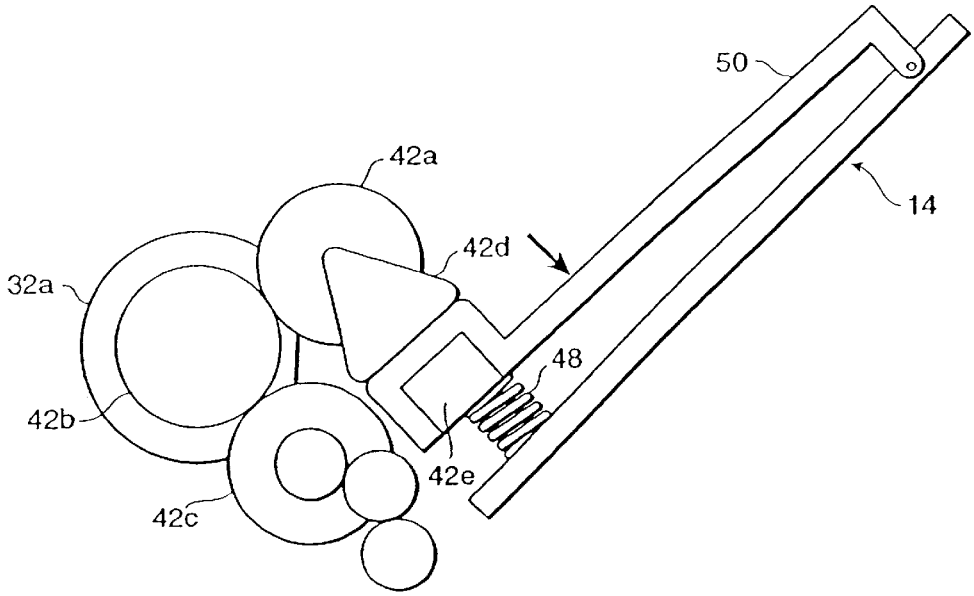
FIGS. 6A and 6B show a geartrain configuration for an automatic sheet feeder of the printer shown in FIG. 1.
Figure 6B:
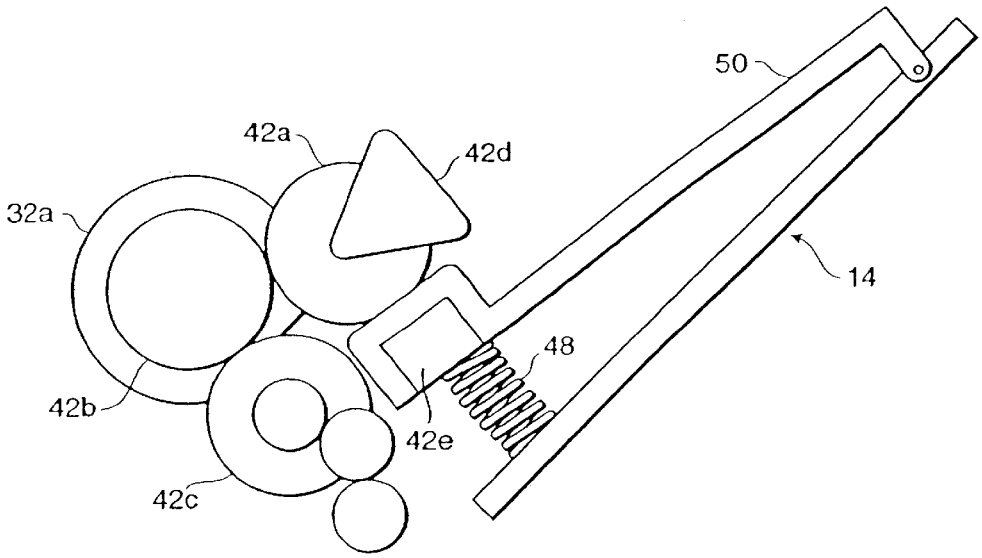

ASF gear train assembly 42 may appear as shown in FIGS. 6A and 6B. As shown in FIG. 6A, gear train assembly 42 comprises gears 42*a*, 42*b* and 42*c*. Gear 42*b* is attached to the end of ASF shaft 38 and turns the shaft when ASF motor 41 is engaged. Gear 42*a* engages gear 42*b* and includes a cam 42*d* that engages an ASF tray detent arm 42*e* of automatic feeder 14. As shown in FIG. 6A, when ASF shaft 38 is positioned at the home position, cam 42*d* presses against detent arm 42*e*. Automatic feeder 14 includes a pivotally mounted plate 50 that is biased by spring 48 so that when cam 42*d* engages detent arm 42*e*, automatic feeder 14 is depressed and when cam 42*d* disengages detent arm 42*e* (such as that shown in FIG. 6B), plate 50 is released. Depressing detent arm 42*e* causes the recording media stacked in automatic feeder 14 to move away from ASF rollers 32*a*, 32*b* and 32*c* and releasing detent arm 42*e* allows the recording to move close to the rollers so that the rollers can engage the recording medium when the ASF motor is engaged.

Returning to FIG. 4, printer 10 includes line feed motor 34 that is utilized for feeding the recording medium through printer 10 during printing operations. Line feed motor 34 drives line feed shaft 36, which includes line feed pinch rollers 36*a*, via line feed geartrain 40. The geartrain ratio for line feed geartrain 40 is set to advance the recording medium a set amount for each pulse of line feed motor 34. The ratio may be set so that one pulse of line feed motor 34 results in a line feed amount of the recording medium equal to a one pixel resolution advancement of the recording medium. That is, if one pixel resolution of the printout of printer 10 is 600 dpi (dots per inch), the geartrain ratio may be set so that one pulse of line feed motor 34 results in a 600 dpi advancement of the recording medium. Alternatively, the ratio may be set so that each pulse of the motor results in a line feed amount that is equal to a fractional portion of one pixel resolution rather than being a one-to-one ratio. Line feed motor 34 preferably comprises a 200-step, 2 phase pulse motor and is controlled in response to signal commands received from circuit board 35. Of course, line feed motor 34 is not limited to a 200-step 2 phase pulse motor and any other type of line feed motor could be employed, including a DC motor with an encoder.

As shown in FIG. 5, printer 10 is a single cartridge printer which prints images using dual print heads, one having nozzles for printing black ink and the other having nozzles for printing cyan, magenta and yellow inks. Specifically, carriage 45 holds cartridge 28 that preferably accommodates ink tanks 43*a*, 43*b*, 43*c* and 43*d*, each containing a different colored ink. A more detailed description of cartridge 28 and ink tanks 43*a* to 43*d* is provided below with regard to FIG. 7. Carriage 45 is driven by carriage motor 39 in response to signal commands received from circuit board 35. Specifically, carriage motor 39 controls the motion of belt 25, which in turn provides for horizontal translation of carriage 45 along carriage guide shaft 51. In this regard, carriage motor 39 provides for bi-directional motion of belt 25, and thus of carriage 45. By virtue of this feature, printer 10 is able to perform bi-directional printing, i.e. print images from both left to right and right to left.

Printer 10 preferably includes recording medium cockling ribs 59. Ribs 59 induce a desired cockling pattern into the recording medium which the printer can compensate for by adjusting the firing frequency of the print head nozzles. Ribs 59 are spaced a set distance apart, depending upon the desired cockling shape. The distance between ribs 59 may be based on motor pulses of carriage motor 39. That is, ribs 59 may be positioned according to how many motor pulses of carriage motor 39 it takes for the print head to reach the location. For example, ribs 59 may be spaced in 132 pulse increments.

Printer 10 also preferably includes pre-fire receptacle areas 44*a*, 44*b* and 44*c*, wiper blade 46, and print head caps 47*a* and 47*b*. Receptacles 44*a* and 44*b* are located at a home position of carriage 45 and receptacle 44*c* is located outside of a printable area and opposite the home position. At desired times during printing operations, a print head pre-fire operation may be performed to eject a small amount of ink from the print heads into receptacles 44*a*, 44*b* and 44*c*. Wiper blade 46 is actuated to move with a forward and backward motion relative to the printer. When carriage 45 is moved to its home position, wiper blade 46 is actuated to move forward and aft so as to traverse across each of the print heads of cartridge 28, thereby wiping excess ink from the print heads. Print head caps 47*a* and 47*b* are actuated in a relative up and down motion to engage and disengage the print heads when carriage 45 is at its home position. Caps 47*a* and 47*b* are actuated by ASF motor 41 via a geartrain (not shown). Caps 47*a* and 47*b* are connected to a rotary pump 52 via tubes (not shown). Pump 52 is connected to line feed shaft 36 via a geartrain (not shown) and is actuated by running line feed motor 34 in a reverse direction. When caps 47*a* and 47*b* are actuated to engage the print heads, they form an airtight seal such that suction applied by pump 52 through the tubes and caps 47*a* and 47*b* sucks ink from the print head nozzles through the tubes and into a waste ink container (not shown). Caps 47*a* and 47*b* also protect the nozzles of the print heads from dust, dirt and debris.

Figure 7:
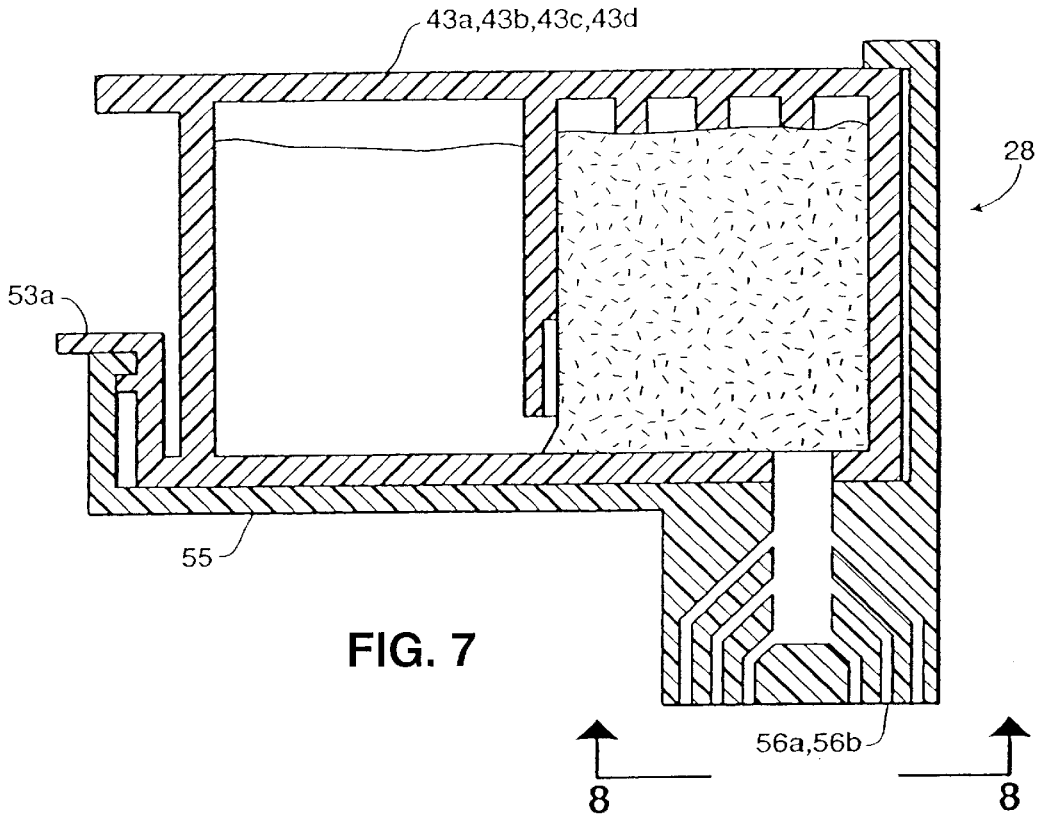
FIG. 7 is a cross-section view through a print cartridge and ink tank of the printer of FIG. 1.

FIG. 7 is a cross section view through one of the ink tanks installed in cartridge 28. Ink cartridge 28 includes cartridge housing 55, print heads 56*a* and 56*b*, and ink tanks 43*a*, 43*b*, 43*c* and 43*d*. Cartridge body 28 accommodates ink tanks 43*a* to 43*d* and includes ink flow paths for feeding ink from each of the ink tanks to either of print heads 56*a* or 56*b*. Ink tanks 43*a* to 43*d* are removable from cartridge 28 and store ink used by printer 10 to print images. Specifically, ink tanks 43*a* to 43*d* are inserted within cartridge 28 and can be removed by actuating retention tabs 53*a* to 53*d*, respectively. Ink tanks 43*a* to 43*d* can store color (e.g., cyan, magenta and yellow) ink and/or black ink. The structure of ink tanks 43*a* to 43*b* may be similar to that described in U.S. Pat. No. 5,509,140, or may be any other type of ink tank that can be in stalled in cartridge 28 to supply ink to print heads 56*a* and 56*b*.

Figure 8:
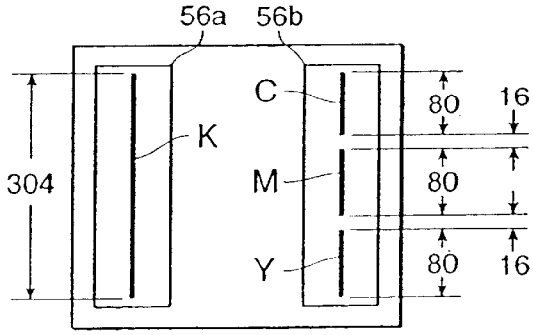
FIG. 8 is a plan view of a print head and nozzle configuration of the print cartridge of FIG. 7.

FIG. 8 depicts a nozzle configuration for each of print heads 56*a* and 56*b*. In FIG. 8, print head 56*a* is for printing black ink and print head 56*b* is for printing color ink. Print head 56*a* preferably includes 304 nozzles at a 600 dpi pitch spacing. Print head 56*b* preferably includes 80 nozzles at a 600 dpi pitch for printing cyan ink, 80 nozzles at a 600 dpi pitch for printing magenta ink, and 80 nozzles at a 600 dpi pitch for printing yellow ink. An empty space is provided between each set of nozzles in print head 56*b* corresponding to 16 nozzles spaced at a 600 dpi pitch. Each of print heads 56*a* and 56*b* eject ink based on commands received from a controller on circuit board 35.

Figure 9:
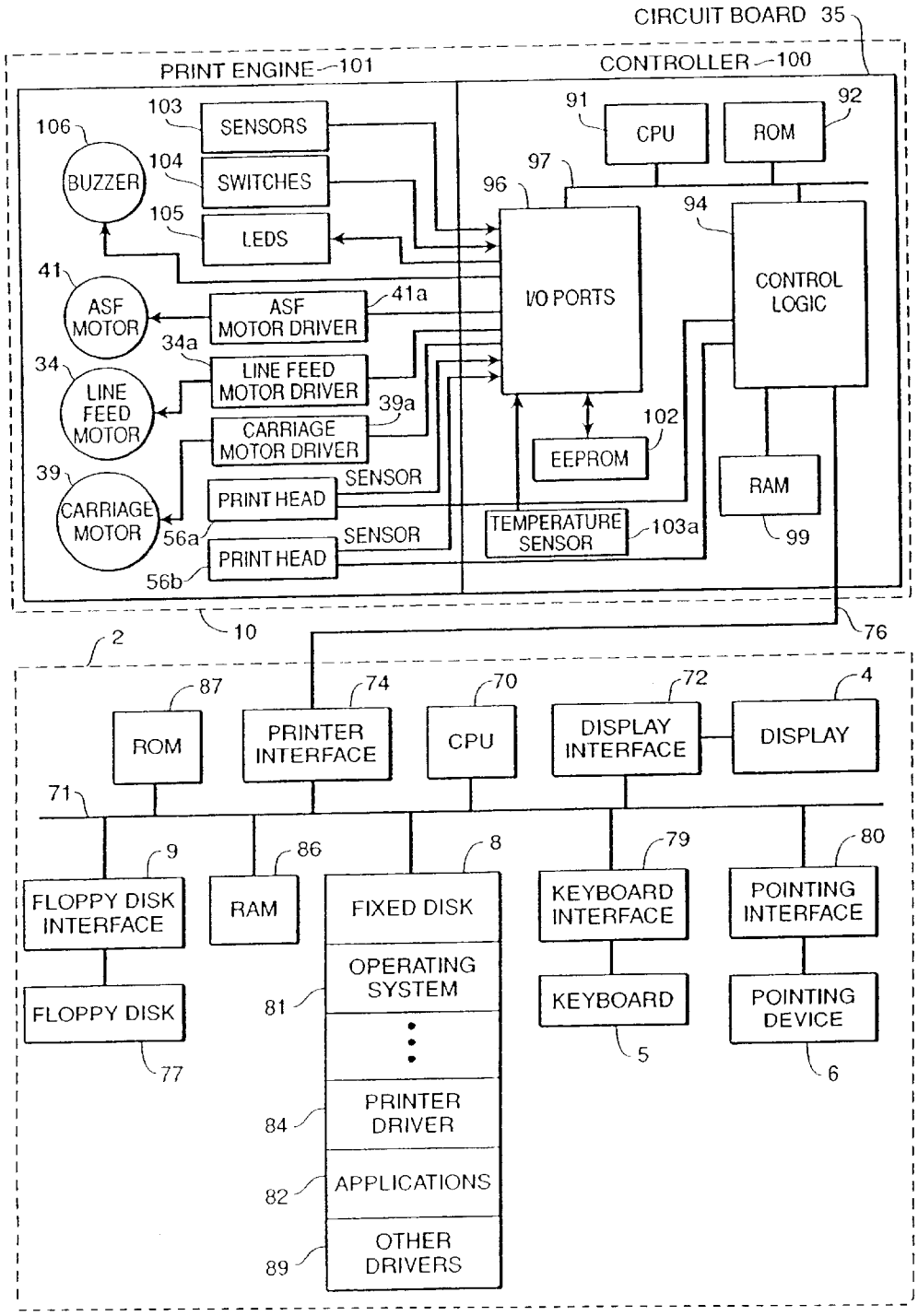
FIG. 9 is a block diagram showing the hardware configuration of a host processor interfaced to the printer of the present invention.

FIG. 9 is a block diagram showing the internal structures of host processor 2 and printer 10. In FIG. 9, host processor 2 includes a central processing unit 70 such as a programmable microprocessor interfaced to computer bus 71. Also coupled to computer bus 71 are display interface 72 for interfacing to display 4, printer interface 74 for interfacing to printer 10 through bi-directional communication line 76, floppy disk interface 9 for interfacing to floppy disk 77, keyboard interface 79 for interfacing to keyboard 5, and pointing device interface 80 for interfacing to pointing device 6. Disk 8 includes an operating system section for storing operating system 81, an applications section for storing applications 82, and a printer driver section for storing printer driver 84.

A random access main memory (hereinafter "RAM") 86 interfaces to computer bus 71 to provide CPU 70 with access to memory storage. In particular, when executing stored application program instruction sequences such as those associated with application programs stored in applications section 82 of disk 8, CPU 70 loads those application instruction sequences from disk 8 (or other storage media such as media accessed via a network or floppy disk interface 9) into random access memory (hereinafter "RAM") 86 and executes those stored program instruction sequences out of RAM 86. RAM 86 provides for a print data buffer used by printer driver 84. It should also be recognized that standard disk-swapping techniques available under the windowing operating system allow segments of memory, including the aforementioned print data buffer, to be swapped on and off of disk 8. Read only memory (hereinafter "ROM") 87 in host processor 2 stores invariant instruction sequences, such as start-up instruction sequences or basic input/output operating system (BIOS) sequences for operation of keyboard 5.

As shown in FIG. 9, and as previously mentioned, disk 8 stores program instruction sequences for a windowing operating system and for various application programs such as graphics application programs, drawing application programs, desktop publishing application programs, and the like. In addition, disk 8 also stores color image files such as might be displayed by display 4 or printed by printer 10 under control of a designated application program. Disk 8 also stores a color monitor driver in other drivers section 89 which controls how multi-level RGB color primary values are provided to display interface 72. Printer driver 84 controls printer 10 for both black and color printing and supplies print data for print out according to the configuration of printer 10. Print data is transferred to printer 10, and control signals are exchanged between host processor 2 and printer 10, through printer interface 74 connected to line 76 under control of printer driver 84. Printer interface 74 and line 76 may be, for example an IEEE 1284 parallel port and cable or a universal serial bus port and cable. Other device drivers are also stored on disk 8, for providing appropriate signals to various devices, such as network devices, facsimile devices, and the like, connected to host processor 2.

Ordinarily, application programs and drivers stored on disk 8 first need to be installed by the user onto disk 8 from other computer-readable media on which those programs and drivers are initially stored. For example, it is customary for a user to purchase a floppy disk, or other computer-readable media such as CD-ROM, on which a copy of a printer driver is stored. The user would then install the printer driver onto disk 8 through well-known techniques by which the printer driver is copied onto disk 8. At the same time, it is also possible for the user, via a modem interface (not shown) or via a network (not shown), to download a printer driver, such as by downloading from a file server or from a computerized bulletin board.

Referring again to FIG. 9, printer 10 includes a circuit board 35 which essentially contain two sections, controller 100 and print engine 101. Controller 100 includes CPU 91 such as an 8-bit or a 16-bit microprocessor including programmable timer and interrupt controller, ROM 92, control logic 94, and I/O ports unit 96 connected to bus 97. Also connected to control logic 94 is RAM 99. Control logic 94 includes controllers for line 5 feed motor 34, for print image buffer storage in RAM 99, for heat pulse generation, and for head data. Control logic 94 also provides control signals for nozzles in print heads 56*a* and 56*b* of print engine 101, carriage motor 39, ASF motor 41, line feed motor 34, and print data for print heads 56*a* and 56*b*. EEPROM 102 is connected to I/O ports unit 96 to provide non-volatile memory for printer information and also stores parameters that identify the printer, the driver, the print heads, the status of ink in the cartridges, etc., which are sent to printer driver 84 of host processor 2 to inform host processor 2 of the operational parameters of printer 10.

I/O ports unit 96 is coupled to print engine 101 in which a pair of print heads 56*a* and 56*b* perform recording on a recording medium by scanning across the recording medium while printing using print data from a print buffer in RAM 99. Control logic 94 is also coupled to printer interface 74 of host processor 2 via communication line 76 for exchange of control signals and to receive print data and print data addresses. ROM 92 stores font data, program instruction sequences used to control printer 10, and other invariant data for printer operation. RAM 99 stores print data in a print buffer defined by printer driver 84 for print heads 56*a* and 56*b* and other information for printer operation.

Sensors, generally indicated as 103, are arranged in print engine 101 to detect printer status and to measure temperature and other quantities that affect printing. A photo sensor (e.g., an automatic alignment sensor) measures print density and dot locations for automatic alignment. Sensors 103 are also arranged in print engine 101 to detect other conditions such as the open or closed status of access door 12, presence of recording media, etc. In addition, diode sensors, including a thermistor, are located in print heads 56*a* and 56*b* to measure print head temperature, which is transmitted to I/O ports unit 96.

I/O ports unit 96 also receives input from switches 104 such as power button 26 and resume button 24 and delivers control signals to LEDs 105 to light indicator light 23, to line feed motor 34 ASF motor 41 and carriage motor 39 through line feed motor driver 34*a*, ASF motor driver 41a and carriage motor driver 39*a*, respectively.

Although FIG. 9 shows individual components of printer 10 as separate and distinct from one another, it is preferable that some of the components be combined. For example, control logic 94 may be combined with I/O ports 96 in an ASIC to simplify interconnections for the functions of printer 10.

Figure 10:
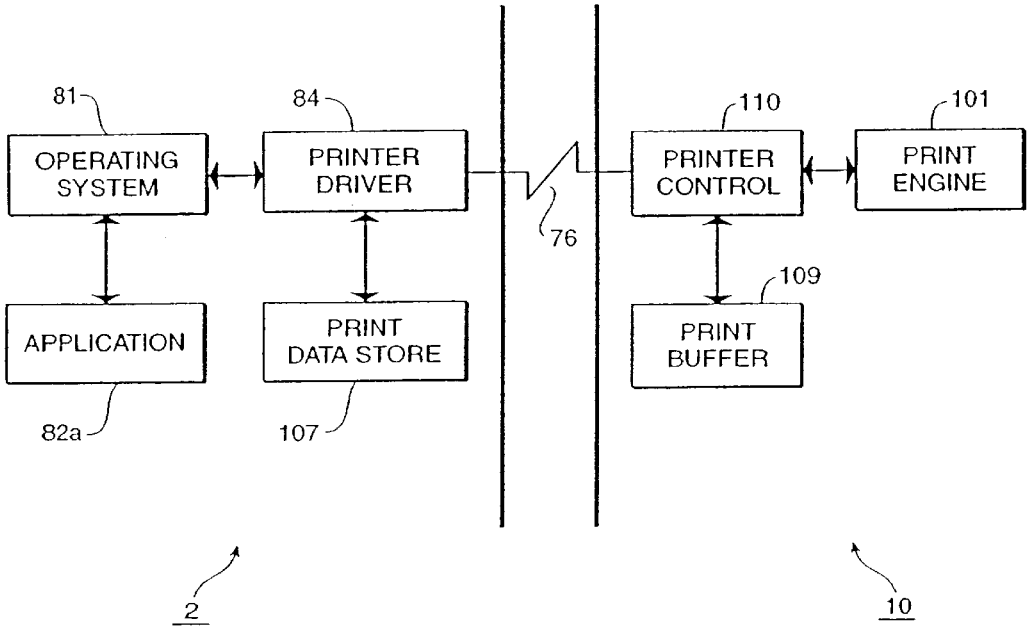
FIG. 10 shows a functional block diagram of the host processor and printer shown in FIG. 8.

FIG. 10 shows a high-level functional block diagram that illustrates the interaction between host processor 2 and printer 10. As illustrated in FIG. 10, when a print instruction is issued from image processing application program 82*a* stored in application section 82 of disk 8, operating system 81 issues graphics device interface calls to printer driver 84. Printer driver 84 responds by generating print data corresponding to the print instruction and stores the print data in print data store 107. Print data store 107 may reside in RAM 86 or in disk 8, or through disk swapping operations of operating system 81 may initially be stored in RAM 86 and swapped in and out of disk 8. Thereafter, printer driver 84 obtains print data from print data store 107 and transmits the print data through printer interface 74, to bi-directional communication line 76, and to print buffer 109 through printer control 110. Print buffer 109 resides in RAM 99, and printer control 110 resides in firmware implemented through control logic 94 and CPU 91 of FIG. 9. Printer control 110 processes the print data in print buffer 109 responsive to commands received from host processor 2 and performs printing tasks under control of instructions stored in ROM 92 (see FIG. 9) to provide appropriate print head and other control signals to print engine 101 for recording images onto recording media.

Print buffer 109 has a first section for storing print data to be printed by one of print heads 56*a* and 56*b*, and a second section for storing print data to be printed by the other one of print heads 56*a* and 56*b*. Each print buffer section has storage locations corresponding to the number of print positions of the associated print head. These storage locations are defined by printer driver 84 according to a resolution selected for printing. Each print buffer section also includes additional storage locations for transfer of print data during ramp-up of print heads 56*a* and 56*b* to printing speed. Print data is transferred from print data store 107 in host processor 2 to storage locations of print buffer 109 that are addressed by printer driver 84. As a result, print data for a next scan may be inserted into vacant storage locations in print buffer 109 both during ramp up and during printing of a current scan.

Figure 11:
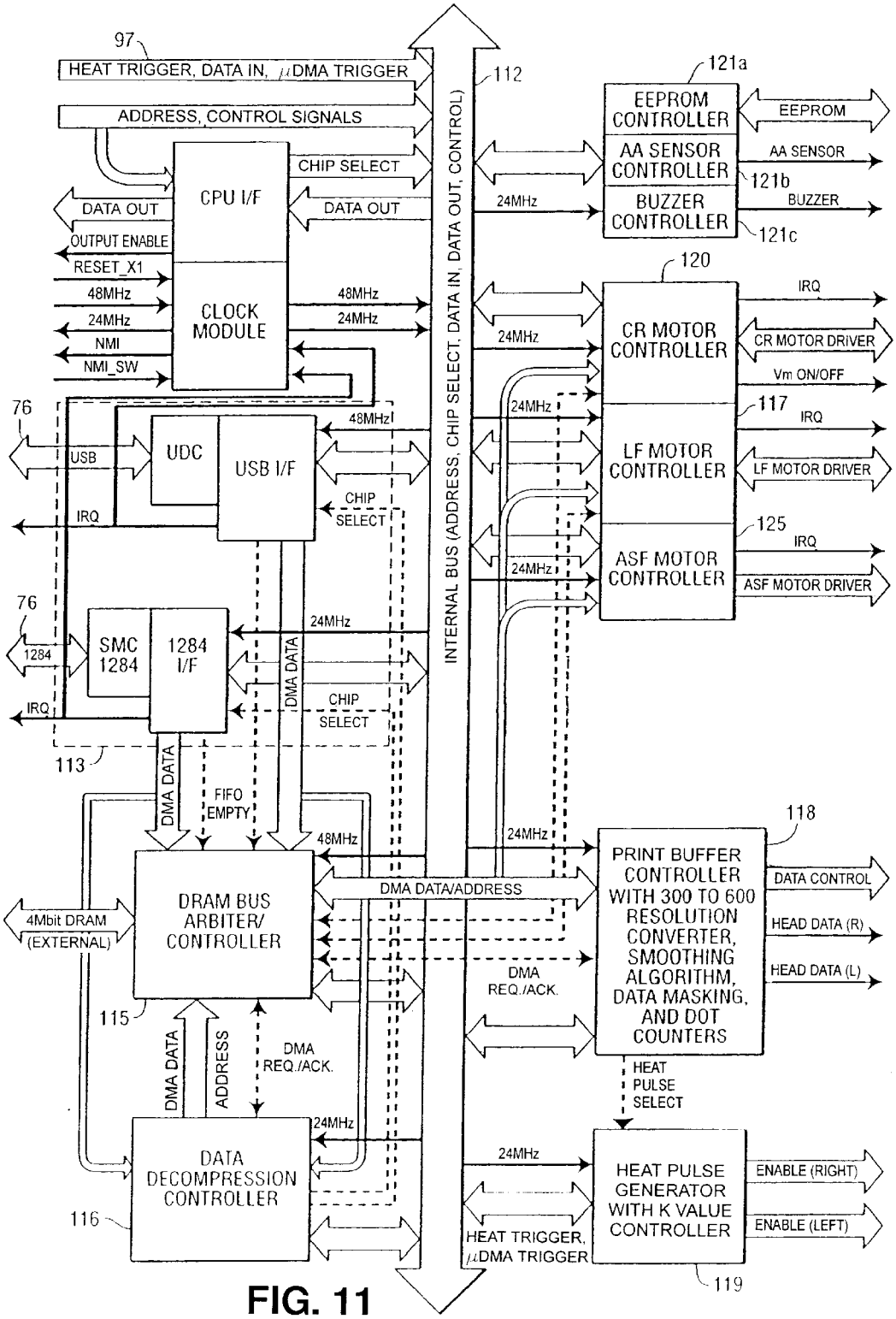
FIG. 11 is a block diagram showing the internal configuration of the gate array shown in FIG. 9.

FIG. 11 depicts a block diagram of a combined configuration for control logic 94 and I/O ports unit 96, which as mentioned above, I/O ports unit 96 may be included within control logic 94. In FIG. 11, internal bus 112 is connected to printer bus 97 for communication with printer CPU 91. Bus 97 receives data signals, address and control signals, micro-DMA trigger and heat trigger signals from CPU 91 and passes the signals along bus 112 to various other components. Bus 112 is coupled to host computer interface 113 (shown in dashed lines) which is connected to bi-directional line 76 for carrying out bi-directional communication. As shown in FIG. 11, bi-directional line 76 may be either an IEEE-1284 line or a USB line. Bi-directional communication line 76 is also coupled to printer interface 74 of host processor 2. Host computer interface 113 includes both IEEE-1284 and USB interfaces, both of which are connected to bus 112 and to DRAM bus arbiter/controller 115 for controlling RAM 99 which includes print buffer 109 (see FIGS. 9 and 10). Data decompressor 116 is connected to bus 112, DRAM bus arbiter/controller 115 and each of the IEEE-1284 and USB interfaces of host computer interface 113 to decompress print data when processing.

Also coupled to bus 112 are line feed motor controller 117 that is connected to line feed motor driver 34*a* of FIG. 9, print buffer controller 118 which provides serial control signals and head data signals for each of print heads 56*a* and 56*b*, heat pulse generator 119 which provides block control signals and analog heat pulses for each of print heads 56*a* and 56*b* based on micro-DMA trigger and heat trigger commands received over bus 112 from CPU 91 via bus 97, carriage motor controller 120 that is connected to carriage motor driver 39*a* of FIG. 9, and ASF motor controller 125 that is connected to ASF motor driver 41*a* of FIG. 9. Additionally, EEPROM controller 121*a*, automatic alignment sensor controller 121*b* and buzzer controller 121*c* are connected to bus 112 for controlling EEPROM 102, an automatic alignment sensor (generally represented within sensors 103 of FIG. 9), and buzzer 106.

Control logic 94 operates to receive commands from host processor 2 for use in CPU 91, and to send printer status and other response signals to host processor 2 through host computer interface 113 and bi-directional communication line 76. Print data and print buffer memory addresses for print data received from host processor 2 are sent to print buffer 109 in RAM 99 via DRAM bus arbiter/controller 115, and the addressed print data from print buffer 109 is transferred through controller 115 to print engine 101 for printing by print heads 56*a* and 56*b*. In this regard, heat pulse generator 119 generates analog heat pulses required for printing the print data.

Figure 12:
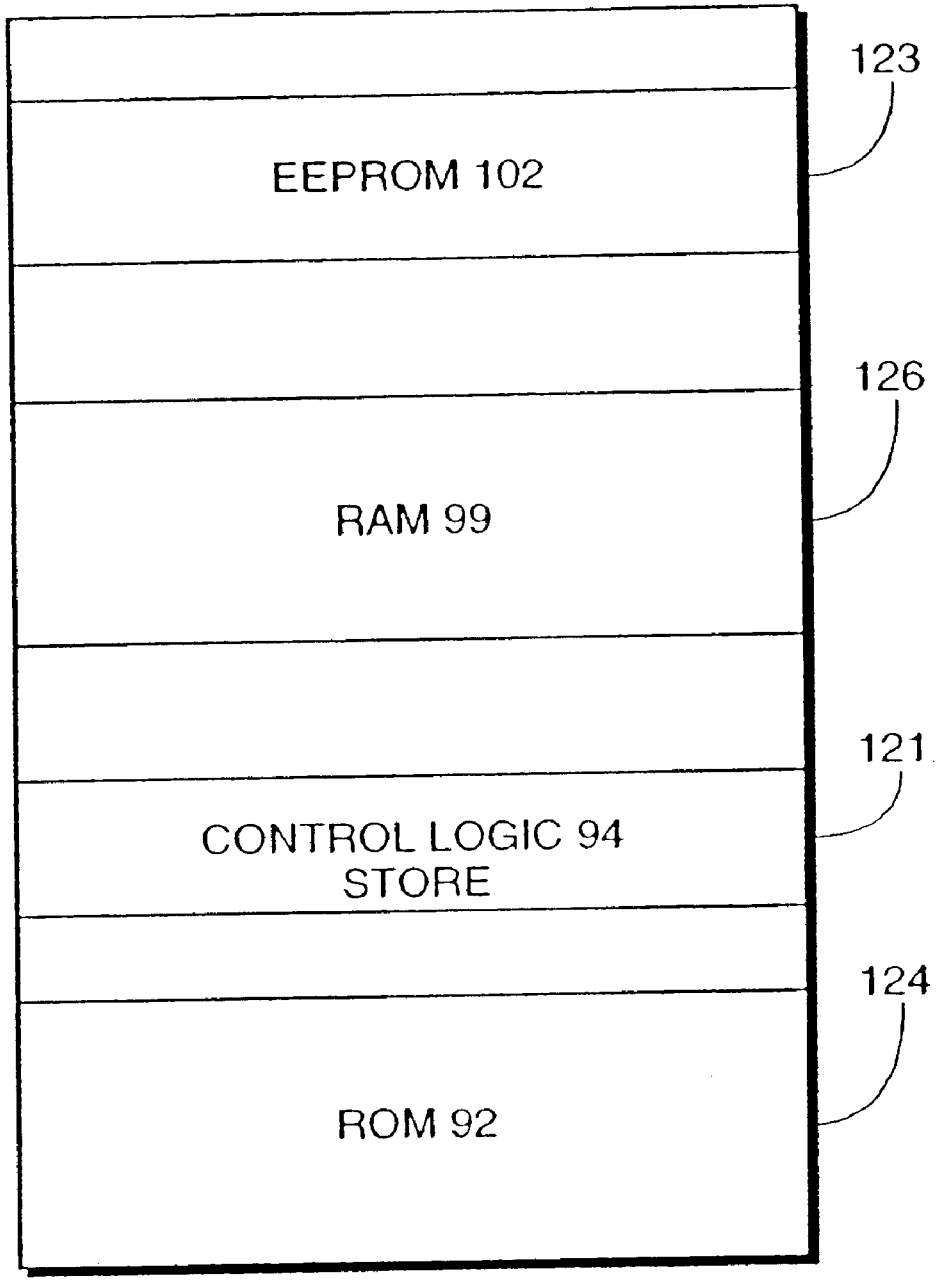
FIG. 12 shows the memory architecture of the printer of the present invention.
Figure 13A:
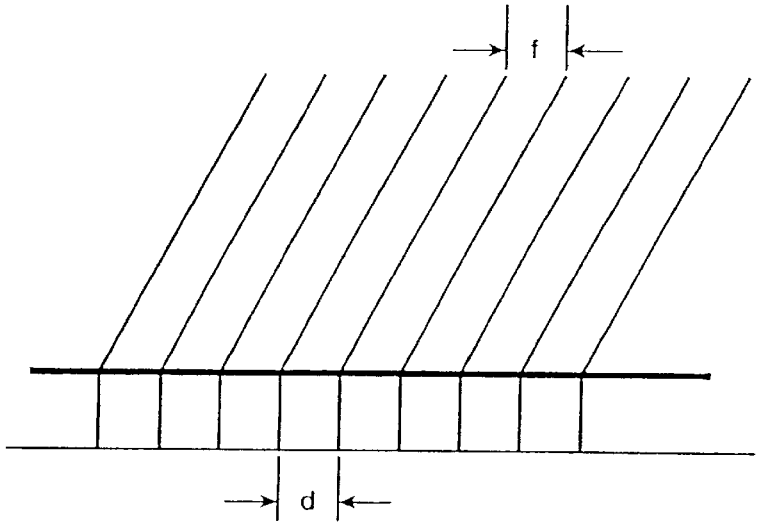
FIGS. 13A and 13B depict an ink droplet spacing in the prior art.
Figure 13B:
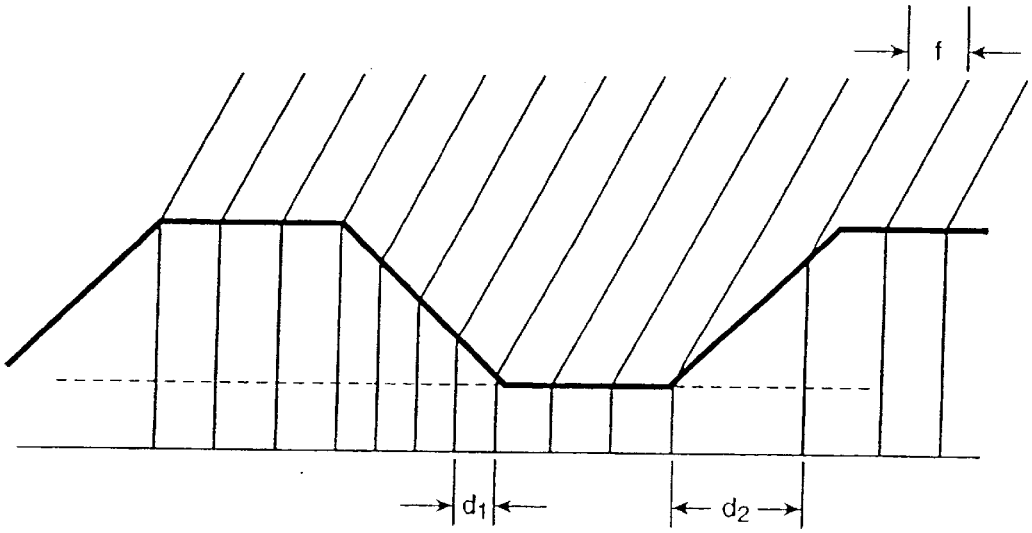

FIG. 12 shows the memory architecture for printer 10. As shown in FIG. 12, EEPROM 102, RAM 99, ROM 92 and temporary storage 121 for control logic 94 form a memory structure with a single addressing arrangement. Referring to FIG. 12, EEPROM 102, shown as non-volatile memory section 123, stores a set of parameters that are used by host processor 2 and that identify printer and print heads, print head status, print head alignment, and other print head characteristics. EEPROM 102 also stores another set of parameters, such as clean time, auto-alignment sensor data, etc., which are used by printer 10. ROM 92, shown as memory section 124, stores information for printer operation that is invariant, such as program sequences for printer tasks and print head operation temperature tables that are used to control the generation of nozzle heat pulses, etc. A random access memory section 121 stores temporary operational information for control logic 94, and memory section 126 corresponding to RAM 99 includes storage for variable operational data for printer tasks and print buffer 109.

A more detailed description will now be made of compensation for paper unevenness with reference to FIGS. 14 to 23. Briefly, compensation for paper unevenness involves determining a location of ink droplet adherence to a flat recording medium, inducing an unevenness (cockling) pattern into the recording medium with known parameters to determine a firing frequency difference for ejecting the ink droplets based on the known parameters, formulating a look-up table having the firing frequency difference based on a horizontal scanning position of a print head and adjusting a firing frequency of the print head. Inducing a known cockling pattern will be discussed first and then formulating the look-up table and adjusting the firing frequency based on the print head scanning position will be discussed.

Figure 14:
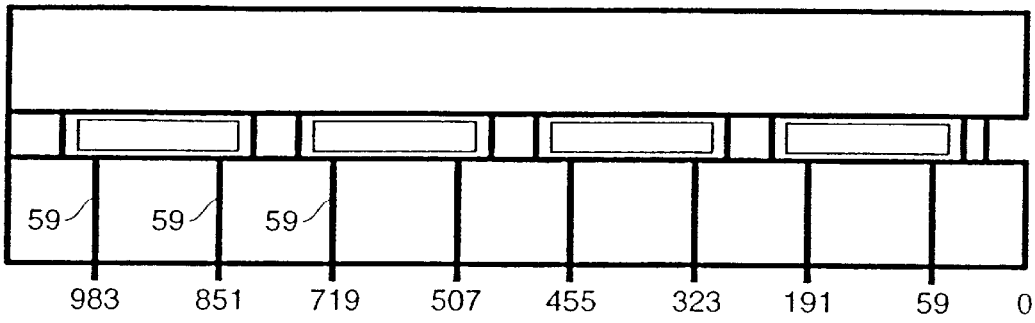
FIG. 14 depicts a top view of a cockling rib spacing according to the invention.

As pointed out above with regard to FIG. 5, printer 10 includes cockling ribs 59. Cockling ribs 59 are utilized to induce a known unevenness pattern into the recording medium. FIG. 14 depicts a top view of one possible spacing of cockling ribs 59. As seen in FIG. 14, cockling ribs 59 may be spaced with a first rib located 59 pulses from a home position (zero) and the remaining ribs being located at 132 pulse increments from one another (59, 191, 323, 455, 587, 719, 851 and 983 pulses, respectively). Pulses refer to pulses of carriage control motor 39. That is, carriage 45 is driven by carriage motor 39 via a drive gear attached to the motor and belt 25. The drive gear has been sized such that each pulse of carriage motor 39 results in a horizontal translation of carriage 45 of five 600 dpi pixels. Therefore, it takes 59 pulses of carriage motor 39 to translate carriage 45 from the home position (zero) to the first rib located 59 pulses away from the home position. Of course, a 132 pulse spacing between cockling ribs 59 is not the only spacing that could be used to practice the invention and any other spacing could be used to achieve the same results as the present invention. However, the inventors herein have discovered that the 132 pulse spacing described above, combined with other features that will be described below, provide for good printing results with reduced image roughness.

Figure 15:
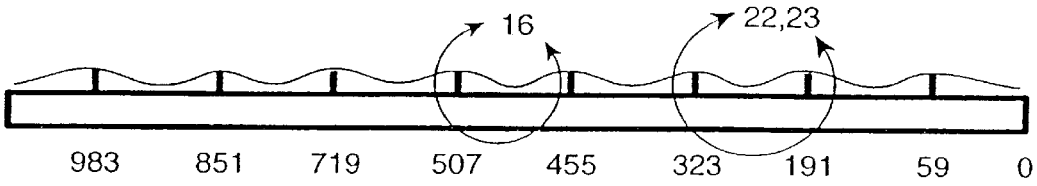
FIG. 15 depicts a front view of a cockling rib spacing according to the invention.

As the recording medium is fed through the printer, it rests on cockling ribs 59. Cockling ribs 59 induce a slight sinusoidal waveform pattern into the recording medium as seen in FIG. 15. Since the spacing of cockling ribs 59 is known (here, 132 pulses as seen in FIG. 14), the period of the sinusoidal waveform pattern (cockling pattern) is also known and corresponds to the spacing of cockling ribs 59. Therefore, the period of the sinusoidal pattern is also 132 pulses. Of course, as stated above, a sinusoidal period of 132 pulses is not required to practice the invention and adjustments to the period size could be made to provide for a different period. As such, the 132 pulse period is merely one example of a period size that may be used to practice the invention. By inducing a known sinusoidal waveform shape into the recording medium, parameters for a determining a firing frequency difference can be determined. It should be noted however, that, as will be described in more detail below, along with the period of the induced sinusoidal shape, the size (height) of the sinusoidal shape is a factor to be taken into consideration when determining the firing frequency difference. In this regard, the height of the sinusoidal shape may be dependent upon the type of recording medium used (i.e. plain paper, card stock, transparency, tissue paper, etc.). That is, some recording mediums have greater rigidity than others and therefore the height of the sinusoidal shape is smaller. As such, a smaller firing frequency difference would be used to compensate for the paper unevenness. The process of determining the firing frequency difference will be discussed next.

As an initial step in determining a firing frequency difference (delta), a base firing frequency (base heat timing) is determined for a flat recording medium. That is, before a firing frequency difference to compensate for a known unevenness pattern can be determined, a base firing frequency for a flat recording medium is first determined. One method of determining a base heat timing will be described with regard to FIGS. 16 and 17. Of course, the invention is not limited to use with the method as will be described with regard to FIGS. 16 and 17 and it can be readily understood by those skilled in the art that various alternative methods could be used.

Figure 16:
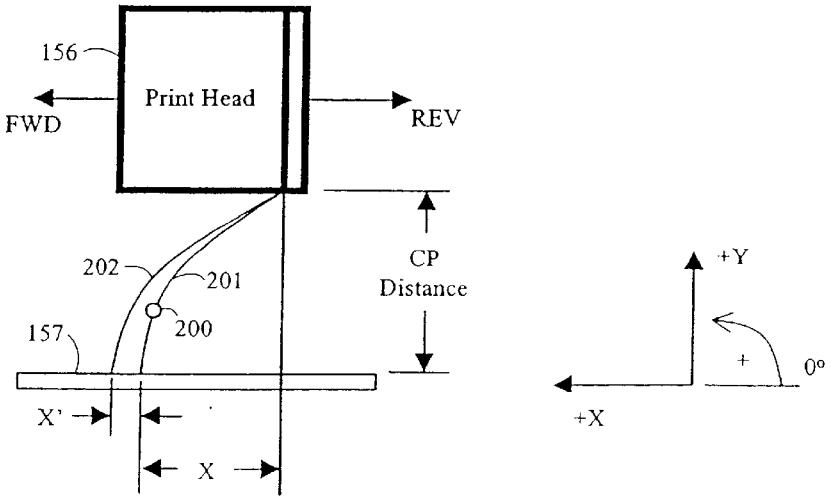
FIG. 16 depicts an example geometry for determining a base heat timing and a delta of the base heat timing due to carriage velocity variations.

FIG. 16 depicts an example geometry for determining a base firing frequency (base heat timing) for a flat recording medium. As seen in the figure, a print head 156, such as print head 56*a* or 56*b*, performs bi-directional (forward and reverse) scanning across a recording medium 157 at a predetermined scanning frequency (for example, 12.5 KHz). An ink droplet 200 is ejected at a predetermined velocity (for example, 15000 mm/sec) and at a predetermined angle (for example, 260 degrees) by the print head, resulting in the ink droplet traveling along a trajectory 201 and contacting the recording medium a horizontal distance X from the point of ejection. It should be noted that trajectory 201 depicts a trajectory for a forward scan of print head 156 where the print head is traveling at 100% of the predetermined velocity. As such, the distance X represents a nominal distance where the print head velocity is 100% of the predetermined amount. However, it can be readily recognized that where the print head travels at a velocity greater than 100%, the ink droplet contact location (and consequently distance X) will vary. In this case, trajectory path 202 depicts a trajectory path for ink droplet 200 when the velocity of print head 156 is greater than 100%, resulting in an offset distance (delta) X' of where ink droplet 200 contacts the recording medium. As will be described below, in determining the base heat timing, such offsets for print head velocity variations are necessarily taken into account.

As also seen in FIG. 16, recording medium 157 is located a distance CP from the print head, and for determining a base firing frequency (base heat timing), is assumed to be flat. That is, to determine a base heat timing, it is first assumed that the recording medium is flat and that the ink droplet will contact the recording medium at an even spacing (such as that shown in FIG. 18A), assuming a constant print head velocity, of course.

Utilizing the foregoing factors (i.e. print head velocity, ink droplet ejection angle and velocity, CP distance, etc.) a base heat timing can be determined for each horizontal scanning position of the print head. Of course, those skilled in the art would recognize that the foregoing factors (i.e. print head scanning frequency, droplet ejection angle and velocity, and CP distance) are all dependent upon a particular printer design and therefore a virtually unlimited number of different values could be used for each printer design. In addition, it can be appreciated that additional factors, such as a printing resolution, could be included in determining a base heat timing for each particular printer design. However, for the sake of brevity, the present discussion will limit the printer design to a case where the print head scanning frequency is 12.5 Khz, the ink droplet ejection angle is 260 degrees, the ink droplet ejection velocity is 15000 mm/sec, the CP distance is 1.2 mm and the printing resolution is 720 dpi.

FIG. 17 depicts an example of a table of values for determining a base heat timing. The values depicted in FIG. 17 have been determined for a case where a print head frequency (head f) is 12.5 KHz, an ink droplet ejection velocity (Vdrop) is 15000 mm/sec, an ink droplet ejection angle (drop ang. or θ) is 260°, and a print resolution (DPI) is 720 dpi. The values depicted in FIG. 17 include base values for variations in carriage velocity (Vcrx chge) and CP distance (CP dist.) (distance from the print head to the surface of the recording medium). Utilizing the foregoing factors and values, and the geometry depicted in FIG. 16, values for other variables utilized in determining the base heat timing can be obtained. For instance, knowing the drop velocity (Vdrop) to be 15000 mm/sec., X and Y components thereof (Vdropx and Vdropy) can be obtained. Of course, the X and Y components for Vdrop could be obtained utilizing any known algorithm for determining vector components, including the equation $$Y=V_0\sin\theta t-\tfrac{1}{2}gt^2$$

Other component values can also be obtained in like manner, such as the velocity of the carriage in the X-direction (Vcrx). However, as stated above, while the value for Vdrop, θ, head f, and dpi remain constant, the velocity of the carriage may vary slightly as the carriage scans horizontally across the surface of the recording medium due to, at least in part, inherent inaccuracies in controlling the carriage drive motor. For instance, as seen in FIG. 17, column 303 for Vcrx chge depicts a variation in the carriage velocity from between 100% and 106%. As such, the velocity of the carriage in the horizontal (X) direction also varies correspondingly as seen in column 304. In addition, column 310 depicts variations in the CP distance from 1.0 mm to 1.4 mm, which results in a variation in the X distance as seen in column 308. As will be discussed below, these carriage velocity and CP distance variations are taken into account when determining a base heat timing.

Once having obtained the values for Vdropx and Vcrx (including any variations due to carriage velocity changes), a total velocity in the X direction (Vxtotal) can be obtained by adding the two values (the resultant values being depicted in column 307 of FIG. 17). Finally, a base value for X can be obtained where the carriage velocity is 100% for each CP distance (i.e. 100% for a CP distance of 1.0 mm, 100% for a CP distance of 1.2 mm, and 100% for a CP distance of 1.4 mm). One such value for X for the present example for a carriage velocity of 100% and a CP distance of 1.2 mm is depicted in cell 320 of FIG. 17. A value for X for each carriage velocity (i.e. 100%, 102%, 104%, 106%) and CP distance (i.e. 1.0 mm, 1.2 mm, and 1.4 mm) can be obtained in like manner. Accordingly, any delta (i.e. difference in the base heat timing), which has been given the value X' in FIG. 17, that may be needed to compensate for the change in carriage velocity for each CP distance is determined simply by comparing the obtained X Dist for each carriage velocity with the base X Dist where the carriage velocity is 100%. The resultant values for X' for each carriage velocity and CP distance are depicted in column 309. These values are utilized as an initial delta of the base heat timing and are used to compensate for carriage velocity variations.

The base heat timing values are thus obtained and preferably stored in table format, such as the base heat timing table depicted in the example of FIG. 17. As will be described below, the values of the base heat timing table are utilized, in conjunction with values obtained from another table (an adjusted firing frequency table), to determine the heat timing (or firing frequency) for the print head at each print head scanning position. It should be noted that in FIG. 17, each row of the table represents a different carriage velocity and CP distance. For instance, row 325 represents values for a carriage velocity of 100% and a CP distance of 1.2 mm, row 326 represents values for a carriage velocity of 102% and a CP distance of 1.2 mm, row 327 represents values for a carriage velocity of 104% and a CP distance of 1.2 mm, etc. Accordingly, the base heat timing value utilized in determining the heat timing delta is dependent upon the carriage velocity and CP distance.

FIG. 17 depicts values for only one particular printer design and as noted above, each printer may include various operating modes. Therefore, it can be appreciated that numerous tables may be used for the same printer design for each of the different operating modes. For instance, a base heat timing table along the lines of that shown in FIG. 17 may be formulated for a case where the operating mode is for a print resolution of 360 dpi rather than 720 dpi, another for a case where the print resolution is changed 1440 dpi, etc. In addition, the print head scanning frequency may be changed based on whether the printer is operating in a letter mode or a draft mode and as such, a different table may be formulated for each mode. Therefore, each particular printer may be provided with several different tables, each of which are formulated for a particular operating mode and therefore, it can be appreciated that the invention is not limited to use with the table shown in FIG. 17.

Having obtained base heat timing values for as many operating conditions as provided for by the printer design, look-up tables for adjusting a firing frequency are then formulated. Generally stated, the adjusted firing frequency look-up tables are utilized in conjunction with the base heat timing table to set a firing frequency for each horizontal scanning position of the print head where ink droplets are to be ejected. Again, numerous tables may be formulated for various operating modes.

Figure 18A:
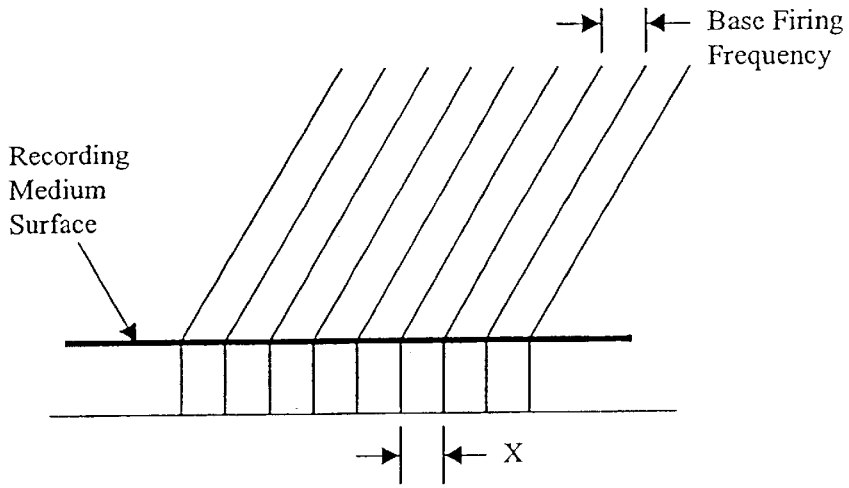
FIG. 18A depicts an example of spacing of ink droplets for a constant ejection frequency onto a flat recording medium.
Figure 18B:
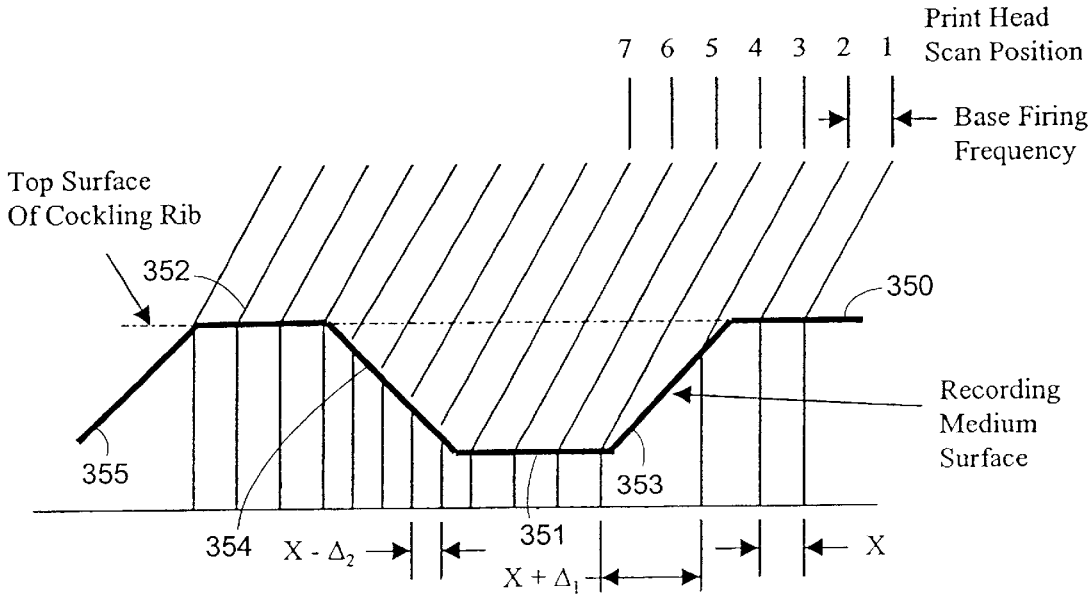
FIG. 18B depicts an example of spacing of ink droplets for a constant ejection frequency onto a recording medium having a known induced unevenness pattern.
Figure 19:
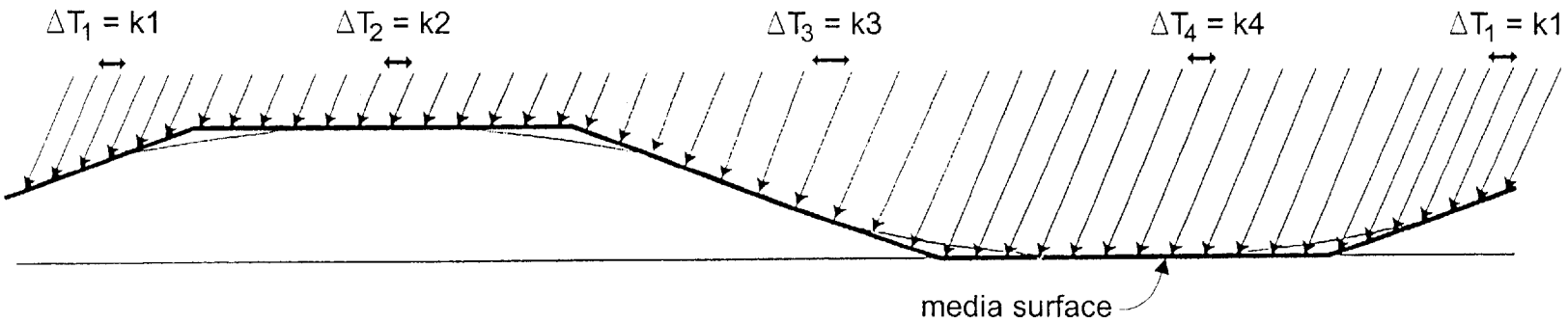
FIG. 19 depicts an example of ink droplet spacing in an alternative method considered by the inventors herein.

The firing frequency look-up tables are preferably generated by considering the known induced cockling pattern. That is, as described above, a known waveform shape is induced into the recording medium with cockling ribs provided at selected print head scan positions. The waveform shape induced into the recording medium can be measured (or alternatively, mathematically estimated) along the scan direction in order to determine an offset (delta) for ink droplet contact with the recording medium. For example, as shown in FIG. 18B, the recording medium surface takes on a waveform shape, which has been significantly mathematically simplified by straight-line segments in the figure. For each print head scan position (0, 1, 2, 3, etc.), when the ink droplet is ejected at a constant base firing frequency (assuming, of course, no variations in the print head velocity), the location of the ink droplet contact with the recording medium can be determined. Some areas of the recording medium (350, 351 and 352, for example) can be estimated as being relatively flat. Accordingly, the ink droplet spacing in these areas can be determined to be substantially equal to the base firing frequency (X). However, other areas of the recording medium (353, 354 and 355, for example) can be estimated as having some degree of slope. Accordingly, in these areas the ink droplet can be estimated to contact the recording medium at some distance either greater ($\Delta_1$) or less ($\Delta_2$) than the base firing frequency. Accordingly, at any given print head scan location, assuming a constant carriage velocity and ink droplet firing frequency, the location of where the ink droplet contacts the recording medium can be determined so as to determine any difference ($\Delta$) from the base firing frequency distance (X) between ink droplets. Knowing the difference ($\Delta$) in the contact distance, a change ($+\Delta$ or $-\Delta$) in the base firing frequency, as well as the number of times the change occurs in a given area of the recording medium (heat time count) can be determined to compensate for the waveform shape of the recording medium.

The difference in the base firing frequency (column heat time delta) for each print head scan position is then inserted into a look-up table. As such, the obtained values for the column heat timing delta and the count (number of successive times the delta is to be applied) are maintained in a table that is utilized by the CPU of the printer to look-up a firing frequency for each print head scan location along the X direction.

While the invention preferably utilizes the foregoing method to formulate the look-up tables during manufacture of the printer, an alternative method in which the look-up tables are generated during a scanning operation could be also be utilized. This method will be described in more detail below.

As stated above, different recording medium types, may result in different waveform shapes of the recording medium. That is, card stock paper generally has greater rigidity than plain paper. As a result, the height of the waveform shape of card stock paper will be smaller than the waveform shape of plain paper. As such, the sloped areas of the recording medium for card stock are not as steep as the sloped areas for plain paper. The smaller slope results in smaller differences ($\Delta$), thereby resulting in smaller firing frequency differences. Accordingly, different look-up tables corresponding to different recording medium types may be formulated and included in the printer.

FIGS. 20A to 20C depict an example of a look-up table containing variables used in the present invention to adjust the firing frequency. As shown, the look-up table preferably includes values for each carriage position (0 to 53 in the illustrated example). However, as an alternate embodiment, the table may be simplified to delete redundancies as shown in FIG. 21. As seen in the table, each of a plurality of Carriage Position values (0 to 53) have a corresponding Column Heat Time Delta value (as determined above with regard to the description of FIG. 18B) and a corresponding Base Column Heat Time value (not shown in the table but as determined above with regard to the description of FIG. 17). The Column Heat Time Delta is added to the Base Column Heat Time to obtain a firing frequency that ensures that the ink droplets contact the paper with a constant spacing, thereby compensating for the paper cockling. The Column Heat Time Count value is the number of successive ink droplets in which the Column Heat Time Delta is applied to the Column Base Heat Time. As can be seen in FIGS. 20A to 20C, both the Column Heat Time Delta and Column Heat Time Count values vary depending upon the carriage position during a particular scan. Utilizing the look-up table illustrated in FIGS. 20A to 20C (or alternatively, FIG. 21), the firing frequency at each print head scan location during the print scan can be adjusted to compensate for paper unevenness.

Figure 22:
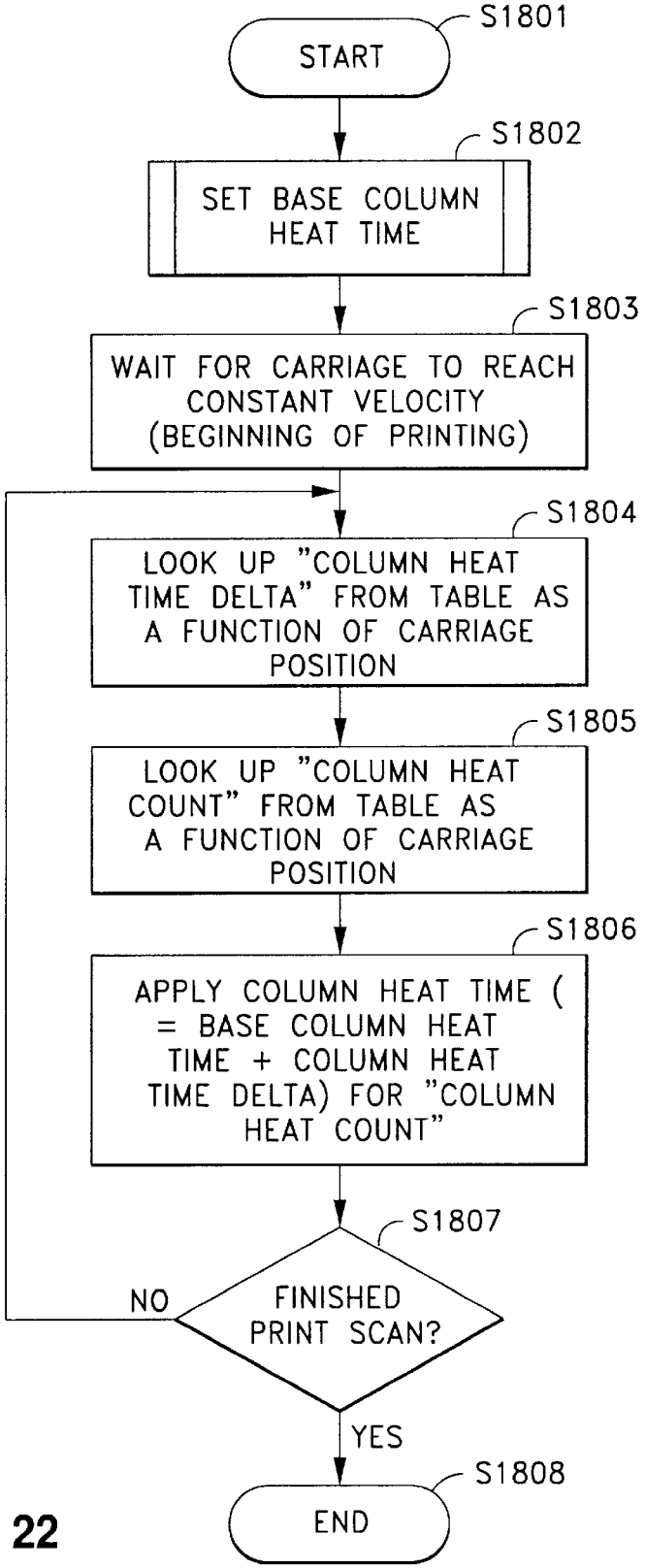
FIG. 22 is a flowchart of process steps for adjusting a firing frequency to compensate for paper cockling according to the invention.

FIG. 22 is a flowchart of process steps for adjusting the firing frequency during print scans according to the invention. The process begins in step S1801 and in step S1802, the Base Column Heat Time value is set. As described above, the Base Column Heat Time is the interval (1/f) between ink droplets ejected along the scan direction. Again, this value is based on several factors, including carriage speed and print mode.

In step S1803, the print carriage is ramped-up to printing velocity and scanning across the recording medium is initiated. In step S1804, a determination of the carriage position in the scan direction is made and the corresponding Column Heat Time Delta value obtained from the look-up table of FIGS. 20A to 20C (or alternatively, FIG. 21). The Column Heat Count value, which as described above is also based upon the carriage position during the scan, is also obtained from the look-up table in step S1805. Then, in step S1806, the Column Heat Time Delta is applied to the Base Column Heat Time for the corresponding number of Column Heat Time Counts. A check is made in step S1807 to determine whether the current print scan has completed, and if not, flow returns to step S1804 whereby steps S1804, S1805, and S1806 are repeated for the next carriage position listed in the look-up table. If the current print scan has completed, the routine ends.

The foregoing process is carried out in CPU 91, in conjunction with print buffer controller 118 and heat pulse generator 119 shown in FIG. 11. As discussed above, print buffer controller 118 outputs serial control signals and print head data signals for each of print heads 56*a* and 56*b*, while heat pulse generator 119 provides block control signals and analog heat pulses for each of print heads 56*a* and 56*b*.

As shown in FIG. 11, CPU 91 provides a heat trigger signal via the CPU's micro-DMA to heat pulse generator 119 via bus 112. This signal is a synchronous, periodic timer-based event that makes use of one of CPU's 91 timers. CPU 91 writes to heat pulse generator 119 at a variable interval time (100 $\mu$sec +/−Δ), which causes heat pulse generator 119 to start a heating cycle while simultaneously loading the next set of data. It is noted that some prior art systems have used CPU-based timer interrupts to generate heat trigger signals. However, these systems consume processing time in servicing interrupts (i.e., stacking status registers, return address, setting new program counter), returning from the interrupts, and reading the program from ROM (i.e., fetch, decode, and execute) associated with heat trigger control. In contrast, the present invention's use of the CPU's micro-DMA allows generation of heat triggers without the aforementioned interrupt processing, thereby eliminating CPU overhead associated with prior systems.

Figure 23:
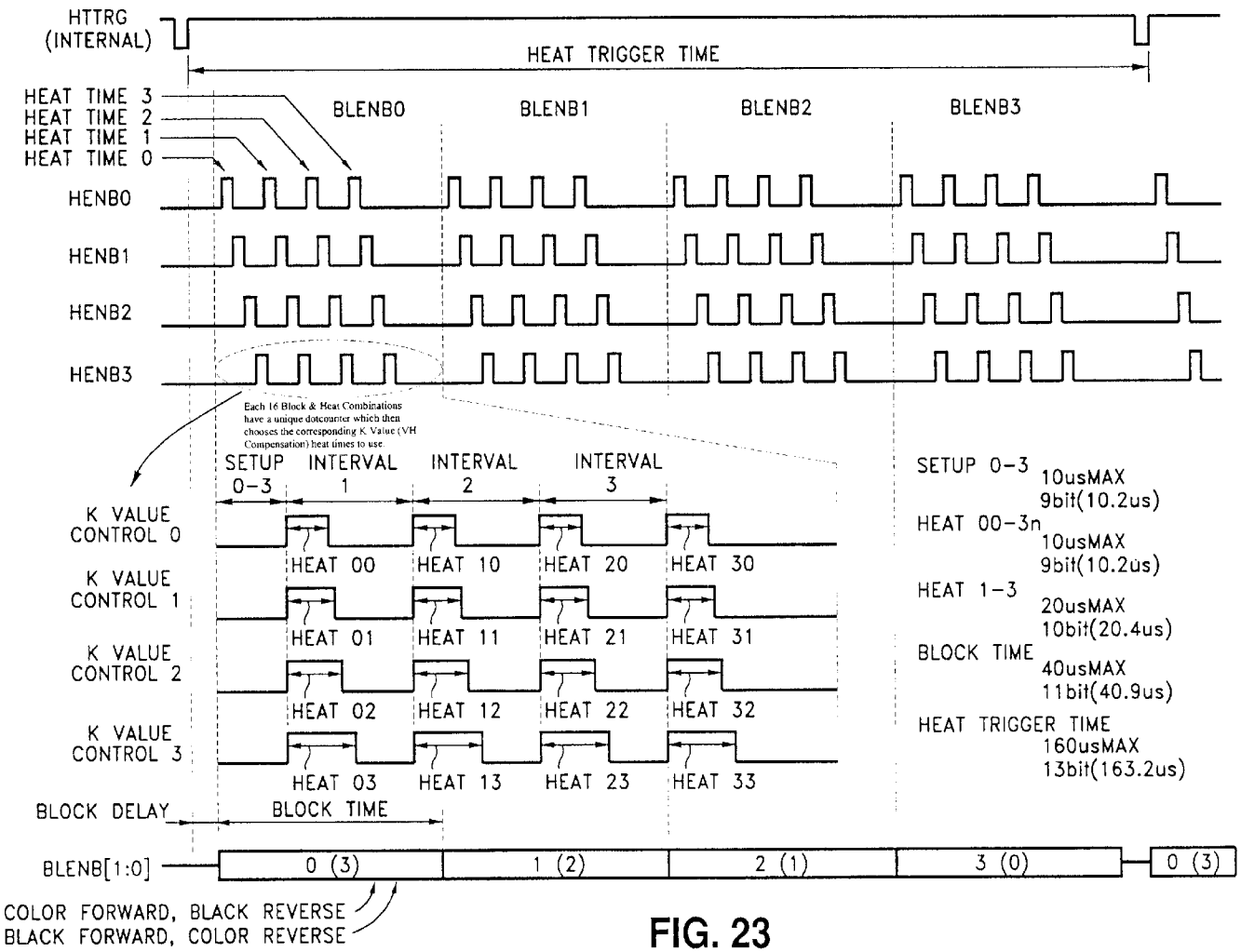
FIG. 23 depicts a timeline of various signals in one period according to the invention.

FIG. 23 is a timeline of the various signals for one period. The signals of FIG. 18 generally correspond to the process steps described above with regard to FIG. 22.

In another embodiment of the invention, the firing frequency adjustment routine is based on detecting changes in the distance between the print head and the recording medium as carriage 45 is scanned across the recording medium. As stated above, the invention preferably utilizes a method where the look-up tables are generated during manufacture of the printer by measuring the induced cockling pattern of the recording medium. However, the look-up tables could be generated "on the fly" by employing a sensor on the printer carriage that measures the distance between the print head and the recording medium as the carriage scans across the recording medium. Such a sensor may be any known mechanical type sensor that travels along the surface of the recording medium and measures the distance, or may be an electronic signal (e.g. radar) or light emitting (e.g. laser) sensor that measures the distance.

In the alternative embodiment, as the carriage scans across the recording medium, the sensor measures the CP distance at predetermined print head scan positions. The measured values are then implemented in an algorithm similar to that described above in which an adjusted ink ejection frequency is calculated. The calculated values can then be inserted into a look-up table which is utilized by the printer CPU to set the firing frequency of the print head. Of course, it is not necessary that the calculated values be stored in a look-up table and they could be stored in and read out of memory instead.

The invention has been described with respect to particular illustrative embodiments. It is to be understood that the invention is not limited to the above-described embodiments and that various changes and modifications may be made by those of ordinary skill in the art without departing from the spirit and scope of the invention.

What is claimed is:

1. A printing method of a printing device in which a print head scans across a recording medium and ejects ink from the print head onto the recording medium, comprising the steps of:

inducing a predetermined unevenness pattern into the recording medium, which is to be compensated for by adjusting an ejection frequency of the print head;

determining an adjusted ink ejection frequency for each of a plurality of print head scan positions for a scan of the print head across the recording medium, the adjusted ink ejection frequency being determined at least in part based on the induced unevenness pattern;

adjusting a base ink ejection frequency for each scan position of the print head based on the determined adjusted ejection frequency; and controlling ink ejection by the print head based on the adjusted ink ejection frequency.

2. A method according to claim 1 further comprising the step of storing the determining adjusted ink ejection frequency in a recording medium, wherein the adjusting step comprises obtaining the stored adjusted ink ejection frequency from the recording medium.

3. A method according to claim 2, wherein the adjusted ink ejection frequency is stored in a look-up table and the adjusting step obtains the adjusted ink ejection frequency from the look-up table.

4. A method according to claim 2, wherein the adjusted ink ejection frequency is determined for a plurality of recording medium types and printing modes of the printing device, and wherein the adjusted ink ejection frequency is stored in a respective look-up table corresponding to each of the plurality of recording medium types and printing modes.

5. A method according to claim 4, wherein the adjusting step comprises obtaining the adjusted ink ejection frequency from a look-up table corresponding to a type of recording medium and a printing mode selected by a user.

6. A method according to claim 1, wherein the controlling step is performed by a CPU in the printing device.

7. A method according to claim 1, wherein the printing device comprises a plurality of print heads and the ink ejection frequency is adjusted for each print head individually.

8. A method according to claim 1, wherein the printing device performs bi-directional printing and the ink ejection frequency is adjusted respectively for a forward printing scan and a reverse printing scan.

9. A method according to claim 1, wherein the determined adjusted ink ejection frequency is based at least in part on a carriage speed of a carriage in the printing device.

10. A method according to claim 1, wherein the printing device comprises a plurality of print heads, each of which are located with respect to each other a distance along a scan direction corresponding to the induced unevenness pattern.

11. A method according to claim 1, wherein the printing device comprises a plurality of print heads, at least one of which corresponds to print data having a first color and at least one of which corresponds to print data having a second color, wherein, in a case where print data of both the first and second colors are to be printed in a same scan, the ink ejection frequency of the at least one print head corresponding to print data having the second color is controlled, and wherein, in a case where only print data of the first color is to be printed in a same scan, the ink ejection frequency of the at least one print head corresponding to print data having the first color is controlled.

12. A method according to claim 1, further comprising detecting a distance between the print head and the recording medium as the print head scans across the recording medium.

13. A method according to claim 12, wherein the detected distance is utilized in the determining step.

14. An ink-jet printing apparatus, comprising:

a print head that scans across a recording medium and ejects ink onto the recording medium;

a mechanism for inducing a predetermined unevenness pattern into the recording medium at least in an area in which the print head scans across the recording medium, wherein the unevenness pattern is to be compensated for by adjusting an ejection frequency of the print head;

a trigger mechanism for effecting ejection of the ink;

a device for determining an adjusted ink ejection frequency for each of a plurality of print head scan positions for a scan of the print head across the recording medium and for adjusting a base ink ejection frequency for each scan position of the print head based on the determined adjusted ink ejection frequency; and a controller for controlling the trigger mechanism to effect ink ejection at the adjusted ink ejection frequency.

15. An ink-jet printing apparatus according to claim 14 further comprising a storage medium for storing the determined adjusted ink ejection frequency, wherein the adjusting device adjusts the ink ejection frequency by obtaining the stored adjusted ink ejection frequency from the storage medium.

16. An ink-jet printing apparatus according to claim 15, wherein the adjusted ink ejection frequency is stored in a look-up table in the storage medium and the adjusting device obtains the adjusted ink ejection frequency from the look-up table.

17. An ink-jet printing apparatus according to claim 15, wherein the adjusted ink ejection frequency is determined for a plurality of recording medium types and printing modes of the apparatus, and wherein the adjusted ink ejection frequency is stored in the storage medium a respective look-up table corresponding to each of the plurality of recording medium types and printing modes.

18. An ink-jet printing apparatus according to claim 17, wherein the adjusting device obtains the adjusted ink ejection frequency from a look-up table corresponding to a type of recording medium and a printing mode selected by a user.

19. An ink-jet printing apparatus according to claim 14, wherein the controller comprises a CPU.

20. An ink-jet printing apparatus according to claim 14, wherein the apparatus comprises a plurality of print heads and the ink ejection frequency is adjusted for each print head individually.

21. An ink-jet printing apparatus according to claim 14, wherein the printing device performs bi-directional printing and the ink ejection frequency is adjusted respectively for a forward printing scan and a reverse printing scan.

22. An ink-jet printing apparatus according to claim 14 further comprising a carriage in which the print head is mounted, and wherein the determined adjusted ink ejection frequency is based at least in part on a speed of the carriage.

23. An ink-jet printing apparatus according to claim 14 further comprising a plurality of print heads, each of which are located with respect to each other a distance along a scan direction corresponding to the induced unevenness pattern.

24. An ink-jet printing apparatus according to claim 14 further comprising a plurality of print heads, at least one of which corresponds to print data having a first color and at least one of which corresponds to print data having a second color, wherein, in a case where print data of both the first and second colors are to be printed in a same scan, the ink ejection frequency of the at least one print head corresponding to print data having the second color is controlled, and wherein, in a case where only print data of the first color is to be printed in a same scan, the ink ejection frequency of the at least one print head corresponding to print data having the first color is controlled.

25. An ink-jet printing apparatus according to claim 14, further comprising a detector that detects a distance between the print head and the recording medium.

26. An ink-jet printing apparatus according to claim 25, wherein the detected distance is utilized in determining the adjusted ink ejection frequency.

27. Computer-executable process steps for a printing method of a printing device in which a print head scans across a recording medium and ejects ink from the print head onto the recording medium, wherein, a predetermined unevenness pattern is induced into the recording medium and the unevenness pattern is to be compensated for by adjusting an ejection frequency of the print head, the executable process steps comprising the steps of:

determining an adjusted ink ejection frequency for each of a plurality of print head scan positions for a scan of the print head across the recording medium, the adjusted ink ejection frequency being determined at least in part based on the induced unevenness pattern;

adjusting a base ink ejection frequency for each scan position of the print head based on the determined adjusted ejection frequency; and controlling ink ejection by the print head based on the adjusted ink ejection frequency.

28. Computer-executable process steps according to claim 27 further comprising the step of storing the determining adjusted ink ejection frequency in a recording medium, wherein the adjusting step comprises obtaining the stored adjusted ink ejection frequency from the recording medium.

29. Computer-executable process steps according to claim 28, wherein the adjusted ink ejection frequency is stored in a look-up table and the adjusting step obtains the adjusted ink ejection frequency from the look-up table.

30. Computer-executable process steps according to claim 28, wherein the adjusted ink ejection frequency is determined for a plurality of recording medium types and printing modes of the printing device, and wherein the adjusted ink ejection frequency is stored in a respective look-up table corresponding to each of the plurality of recording medium types and printing modes.

31. Computer-executable process steps according to claim 30, wherein the adjusting step comprises obtaining the adjusted ink ejection frequency from a look-up table corresponding to a type of recording medium and a printing mode selected by a user.

32. Computer-executable process steps according to claim 27, wherein the controlling step is performed by a CPU in the printing device.

33. Computer-executable process steps according to claim 27, wherein the printing device comprises a plurality of print heads and the ink ejection frequency is adjusted for each print head individually.

34. Computer-executable process steps according to claim 27, wherein the printing device performs bi-directional printing and the ink ejection frequency is adjusted respectively for a forward printing scan and a reverse printing scan.

35. Computer-executable process steps according to claim 27, wherein the determined adjusted ink ejection frequency is based at least in part on a carriage speed of a carriage in the printing device.

36. Computer-executable process steps according to claim 27, wherein the printing device comprises a plurality of print heads, each of which are located with respect to each other a distance along a scan direction corresponding to the induced unevenness pattern.

37. Computer-executable process steps according to claim 27, wherein the printing device comprises a plurality of print heads, at least one of which corresponds to print data having a first color and at least one of which corresponds to print data having a second color, wherein, in a case where print data of both the first and second colors are to be printed in a same scan, the ink ejection frequency of the at least one print head corresponding to print data having the second color is controlled, and wherein, in a case where only print data of the first color is to be printed in a same scan, the ink ejection frequency of the at least one print head corresponding to print data having the first color is controlled.

38. Computer-executable process steps according to claim 27, further comprising the step of detecting a distance between the print head and the recording medium as the print head scans across the recording medium.

39. Computer-executable process steps according to claim 38, wherein the detected distance is utilized in the determining step.

40. A computer-readable medium which stores computer executable process steps for a printing method of a printing device in which a print head scans across a recording medium and ejects ink from the print head onto the recording medium, wherein, a predetermined unevenness pattern is induced into the recording medium and the unevenness pattern is to be compensated for by adjusting an ejection frequency of the print head, the executable process steps comprising the steps of:

determining an adjusted ink ejection frequency for each of a plurality of print head scan positions for a scan of the print head across the recording medium, the adjusted ink ejection frequency being determined at least in part based on the induced unevenness pattern;

adjusting a base ink ejection frequency for each scan position of the print head based on the determined adjusted ejection frequency; and controlling ink ejection by the print head based on the adjusted ink ejection frequency.

41. A computer-readable medium according to claim 40 further comprising the step of storing the determining adjusted ink ejection frequency in a recording medium, wherein the adjusting step comprises obtaining the stored adjusted ink ejection frequency from the recording medium.

42. A computer-readable medium according to claim 41, wherein the adjusted ink ejection frequency is stored in a look-up table and the adjusting step obtains the adjusted ink ejection frequency from the look-up table.

43. A computer-readable medium according to claim 41, wherein the adjusted ink ejection frequency is determined for a plurality of recording medium types and printing modes of the printing device, and wherein the adjusted ink ejection frequency is stored in a respective look-up table corresponding to each of the plurality of recording medium types and printing modes.

44. A computer-readable medium according to claim 43, wherein the adjusting step comprises obtaining the adjusted ink ejection frequency from a look-up table corresponding to a type of recording medium and a printing mode selected by a user.

45. A computer-readable medium according to claim 40, wherein the controlling step is performed by a CPU in the printing device.

46. A computer-readable medium according to claim 40, wherein the printing device comprises a plurality of print heads and the ink ejection frequency is adjusted for each print head individually.

47. A computer-readable medium according to claim 40, wherein the printing device performs bi-directional printing and the ink ejection frequency is adjusted respectively for a forward printing scan and a reverse printing scan.

48. A computer-readable medium according to claim 40, wherein the determined adjusted ink ejection frequency is based at least in part on a carriage speed of a carriage in the printing device.

49. A computer-readable medium according to claim 40, wherein the printing device comprises a plurality of print heads, each of which are located with respect to each other a distance along a scan direction corresponding to the induced unevenness pattern.

50. A computer-readable medium according to claim 40, wherein the printing device comprises a plurality of print heads, at least one of which corresponds to print data having a first color and at least one of which corresponds to print data having a second color, wherein, in a case where print data of both the first and second colors are to be printed in a same scan, the ink ejection frequency of the at least one print head corresponding to print data having the second color is controlled, and wherein, in a case where only print data of the first color is to be printed in a same scan, the ink ejection frequency of the at least one print head corresponding to print data having the first color is controlled.

51. A computer-readable medium according to claim 40, further comprising the step of detecting a distance between the print head and the recording medium as the print head scans across the recording medium.

52. A computer-readable medium according to claim 51, wherein the detected distance is utilized in the determining step.

* * * * *